US010877408B2

(12) United States Patent
Nishizawa et al.

(10) Patent No.: US 10,877,408 B2
(45) Date of Patent: Dec. 29, 2020

(54) ELECTROMAGNETIC INDUCTION IMAGE HEATING APPARATUS HAVING A CURRENT MONITORING SENSOR

(71) Applicant: CANON KABUSHIKI KAISHA, Tokyo (JP)

(72) Inventors: Yuki Nishizawa, Yokohama (JP); Minoru Hayasaki, Mishima (JP); Aoji Isono, Naka-gun (JP); Akira Kuroda, Numazu (JP); Takaaki Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/586,343

(22) Filed: Sep. 27, 2019

(65) Prior Publication Data

US 2020/0103800 A1 Apr. 2, 2020

(30) Foreign Application Priority Data

Sep. 28, 2018 (JP) ..... 2018-183212

(51) Int. Cl.
*G03G 15/20* (2006.01)
*H05B 6/36* (2006.01)

(52) U.S. Cl.
CPC ..... *G03G 15/2053* (2013.01); *G03G 15/2017* (2013.01); *H05B 6/365* (2013.01)

(58) Field of Classification Search
CPC . G03G 15/2053; G03G 15/2017; H05B 6/365
See application file for complete search history.

(56) References Cited

U.S. PATENT DOCUMENTS

| | | | | |
|---|---|---|---|---|
| 9,377,733 | B2 | 6/2016 | Nishizawa et al. | |
| 9,618,889 | B2 | 4/2017 | Nishizawa et al. | |
| 2019/0018350 | A1* | 1/2019 | Usui | G03G 15/2053 |

FOREIGN PATENT DOCUMENTS

| | | | |
|---|---|---|---|
| JP | 2010-134035 | A | 6/2010 |
| JP | 2014-026267 | A | 2/2014 |
| JP | 2015-118232 | A | 6/2015 |
| JP | 2015-125443 | A | 7/2015 |
| JP | 2017223819 | A * | 12/2017 |

* cited by examiner

*Primary Examiner* — Sophia S Chen
(74) *Attorney, Agent, or Firm* — Venable LLP

(57) ABSTRACT

An image heating apparatus including a sleeve having divided heat generating layers, an exciting coil provided in an inside space of the sleeve, a magnetic core provided inside the exciting coil, a temperature detecting element opposing one of the divided heat generating layers, and a current monitoring sensor. An induced current is generated in the divided heat generating layers by passing an alternating current through the exciting coil, and the divided heat generating layers generate heat. An image on the recording material is heated by the divided heat generating layers. The current monitoring sensor is configured to monitor a current flowing through the above-described one of the divided heating generating layers.

15 Claims, 17 Drawing Sheets

(a)

(b)

(a)

(b)

(a) NO BREAKAGE OF FILM 20

(b) BREAKAGE OF FILM 20

(a) CRACK IN CONVENTIONAL SLEEVE (b) CRACK IN SLEEVE DIVIDED

ELECTROMAGNETIC INDUCTION IMAGE HEATING APPARATUS HAVING A CURRENT MONITORING SENSOR

CROSS-REFERENCE TO RELATED APPLICATION

This application claims the benefit of Japanese Patent Application No. 2018-183212 filed on Sep. 28, 2018, which is hereby incorporated by reference herein in its entirety.

FIELD OF THE INVENTION AND RELATED ART

The present invention relates to an image heating apparatus such as a fixing device mounted in an image forming apparatus of an electrophotographic type, and particularly relates to the image heating apparatus of an electromagnetic induction heating type.

As the fixing device of the electromagnetic induction heating type, there is a fixing device in which an exciting coil and a magnetic core are provided inside a fixing sleeve and in which the fixing sleeve is caused to generate heat by an induced current flowing in a circumferential direction of the fixing sleeve (Japanese Laid-Open Patent Application (JP-A) 2014-026267).

Here, when a breakage occurs in a heat generating layer (electroconductive layer), as shown in part (a) of FIG. 23, current flowing through the electroconductive layer detours around an end portion C2 of a crack C. In part (a) of FIG. 23, the crack occurs in zone Z2 and not in zones Z1. As a result, large heat generation occurs locally. On the other hand, in JP-A 2015-118232, a heat generating layer is electrically divided with respect to a rotational axis direction. This heat generating layer of a fixing sleeve is JP-A 2015-118232 includes a plurality of divided heat generating layers. As a result, an amount of a current detouring at a crack end portion is suppressed, so that locally large heat generation is prevented from occurring (part (b) of FIG. 23). In part (b) of FIG. 23, the crack occurs in zone Z4 and not in zones Z3.

Incidentally, even when the crack C does not occur, for example, the fixing sleeve abnormally generates heat when the exciting coil is controlled abnormally due to controller trouble. An element for monitoring a temperature of the fixing sleeve is provided for such a situation, and a safety circuit for shutting off supply of electric power to the exciting coil is used when abnormal heat generation is detected.

In a fixing device using the fixing sleeve including the divided heat generating layers, as shown in part (b) of FIG. 23, the divided heat generating layer does not generate heat when the crack occurs in the divided heat generating layer corresponding to a position where a temperature detecting element is provided. On the other hand, when an alternating current continuously flows through the exciting coil due to the controller trouble, there is a possibility that the divided heat generating layers in which the crack does not occur continue heat generation and increases in temperature to an abnormal temperature. At this time, the temperature detecting element corresponding to the divided heat generating layer in which the crack occurs cannot detect the abnormal temperature, so that the safety circuit does not function. If all the divided heat generating layers are provided with temperature detecting elements, the safety circuit functions even when the crack occurs at any place, but results in increased cost.

A principal object of the present invention is to provide an image heating apparatus capable of shutting off energization to an exciting coil even when a crack occurs at any of a plurality of ring-shaped divided heat generating layers.

SUMMARY OF THE INVENTION

According to one aspect, the present invention provides an image heating apparatus. The image heating apparatus includes a sleeve, an exciting coil, a magnetic core a temperature detecting element, and a current monitoring sensor. The sleeve is rotatable while contacting a recording material on which an image is formed. The sleeve includes a plurality of divided heat generating layers arranged along a longitudinal direction of the sleeve. Each of the divided heat generating layers has a ring shape. The exciting coil is provided in an inside space of the and has a helix substantially parallel to the longitudinal direction of the sleeve. The magnetic core is provided inside the exciting coil. The temperature detecting element opposes one of the divided heat generating layers. An induced current is generated in the divided heat generating layers by passing an alternating current through the exciting coil, and the divided heat generating layers generate heat. The image on the recording material is heated by the divided heat generating layers. The current monitoring sensor is configured to monitor a current flowing through the one of the divided heat generating layers.

Further features of the present invention will become apparent from the following description of exemplary embodiments with reference to the attached drawings.

Figure 4:
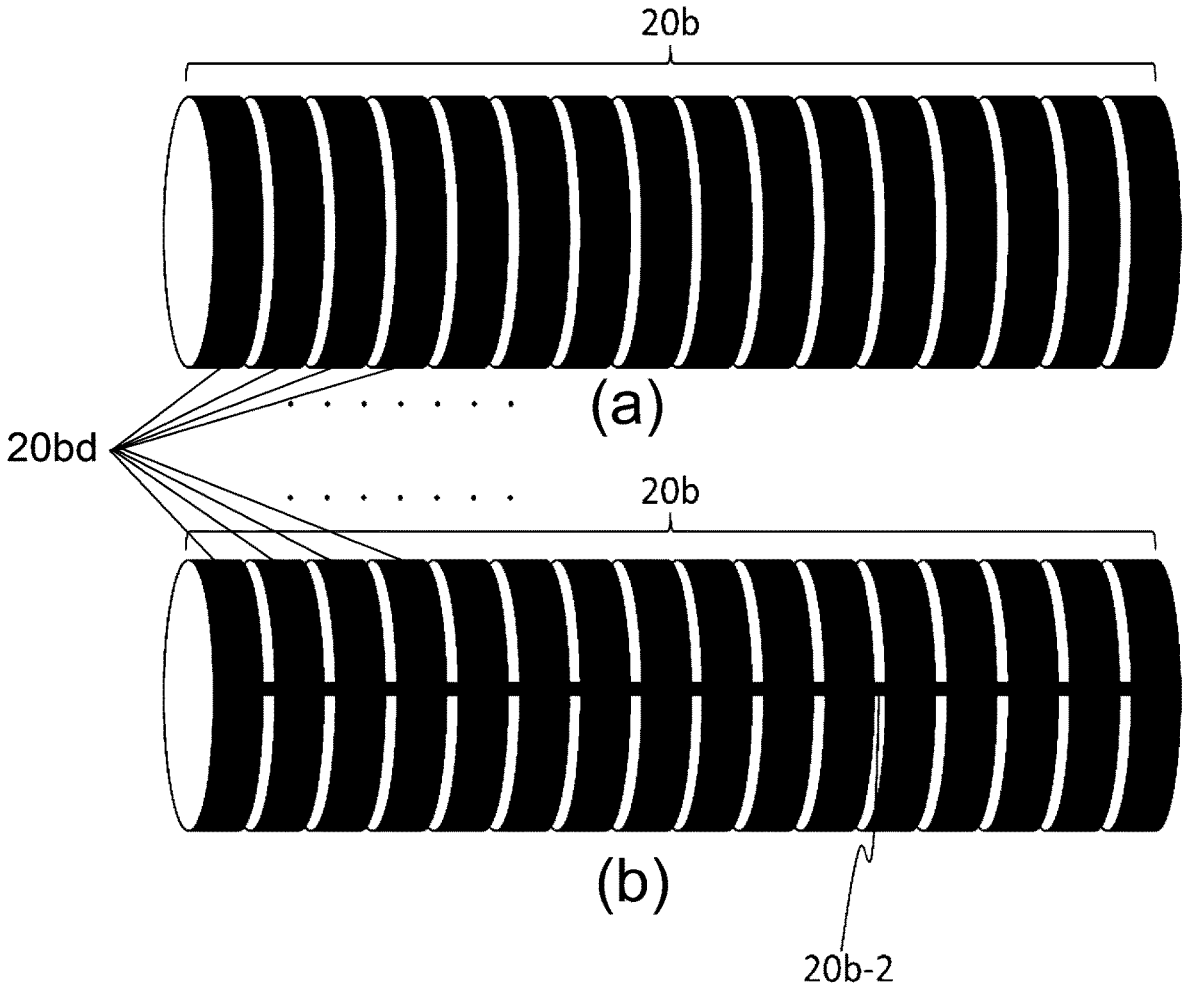

Parts (a) and (b) of FIG. 4 are illustrations of heat generating patterns.

Figure 5:
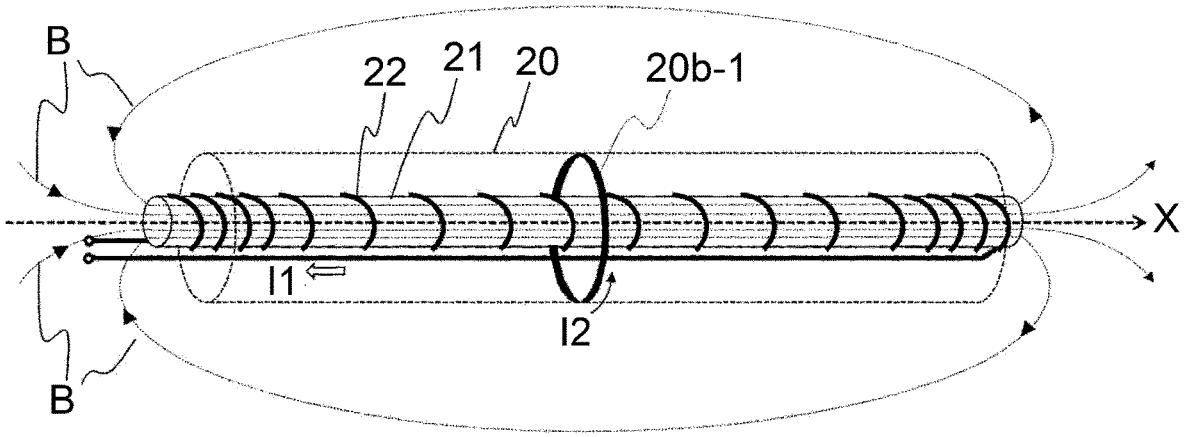

FIG. 5 is a schematic diagram of a magnetic field at a periphery of a core and an induced current induced to a sleeve heat generating pattern.

Figure 6:
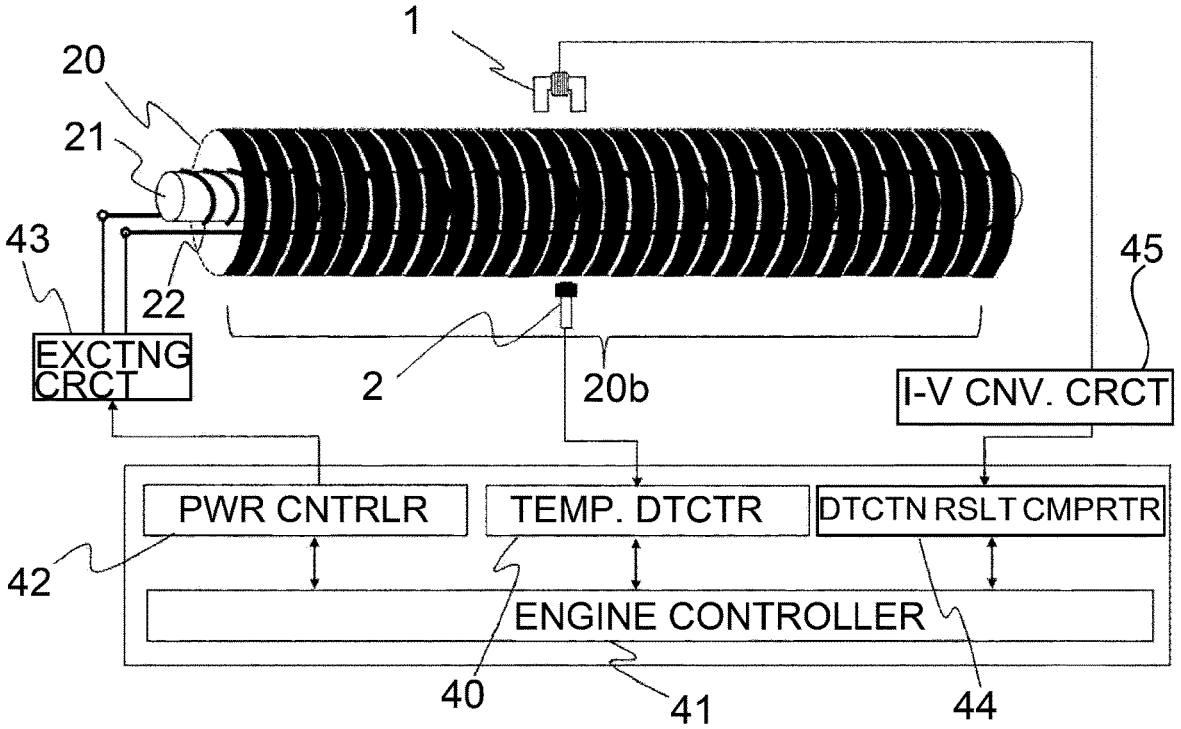

FIG. 6 is a schematic diagram for illustrating temperature control by a thermistor.

Figure 7:
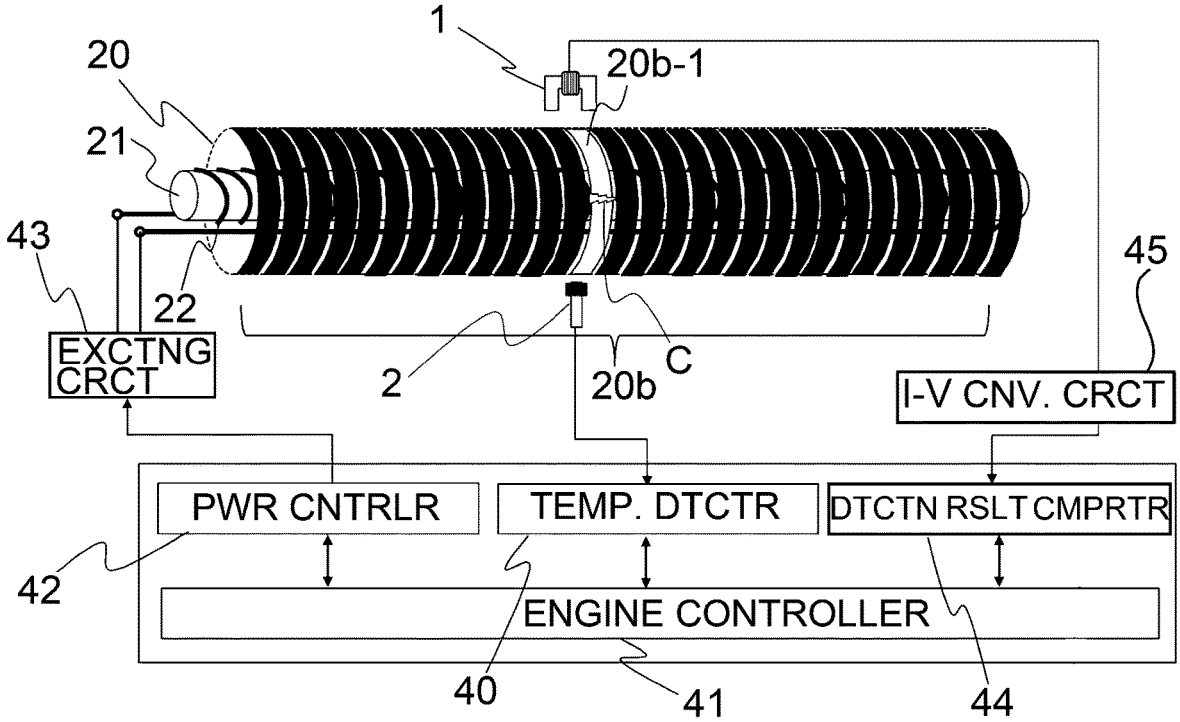

FIG. 7 is a schematic diagram for illustrating the case when breakage C, such as a crack, occurs in a rotatable member.

Figure 8:
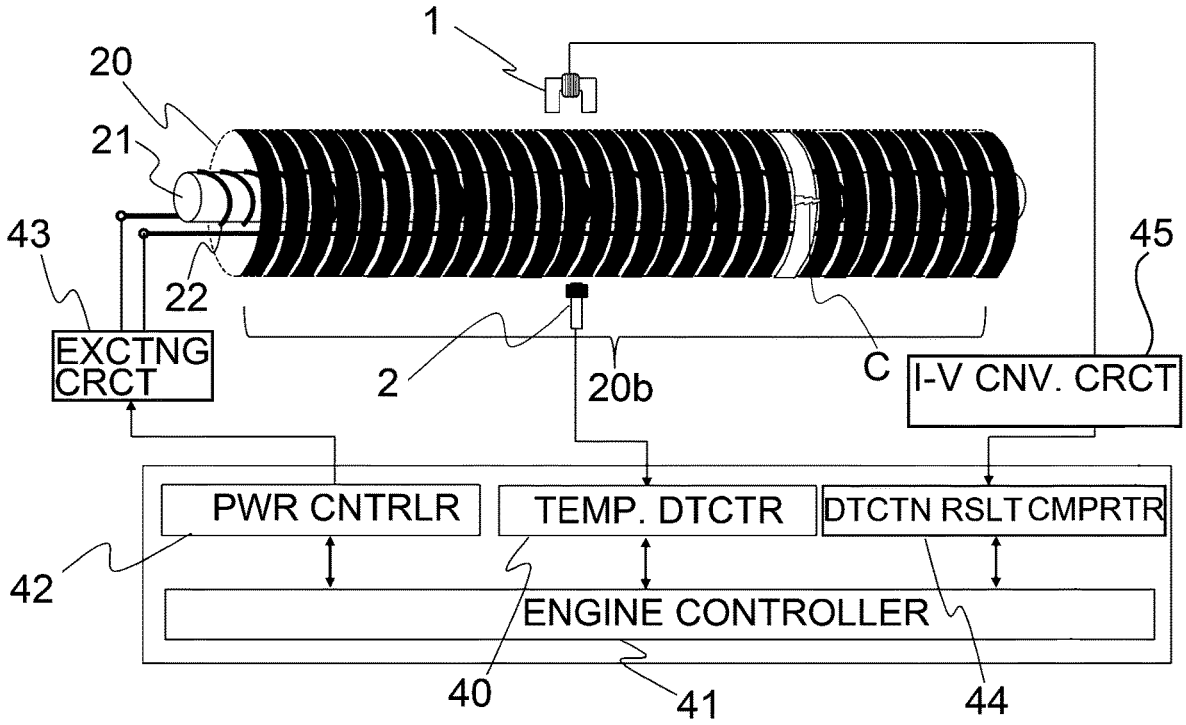

FIG. 8 is a schematic diagram for illustrating the case when the breakage C occurs at a place other than a position where a temperature detecting element is provided.

Figure 9:
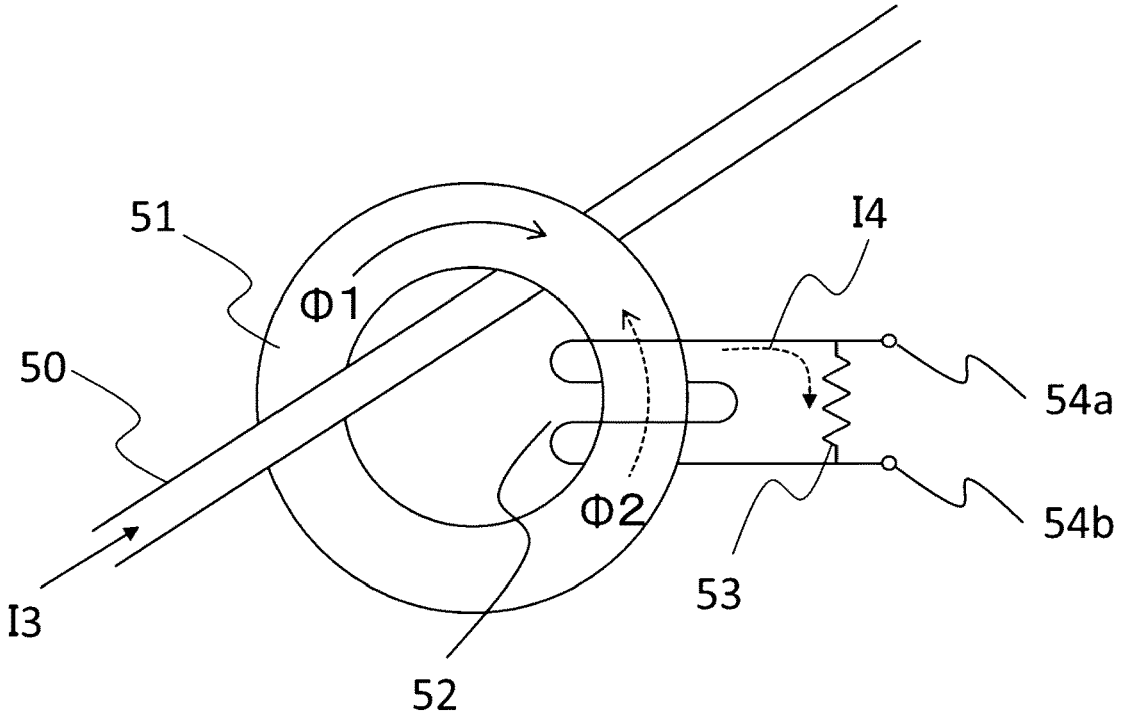

FIG. 9 is an illustration of a measurement principle of a current sensor of a current transformer type.

Figure 10:
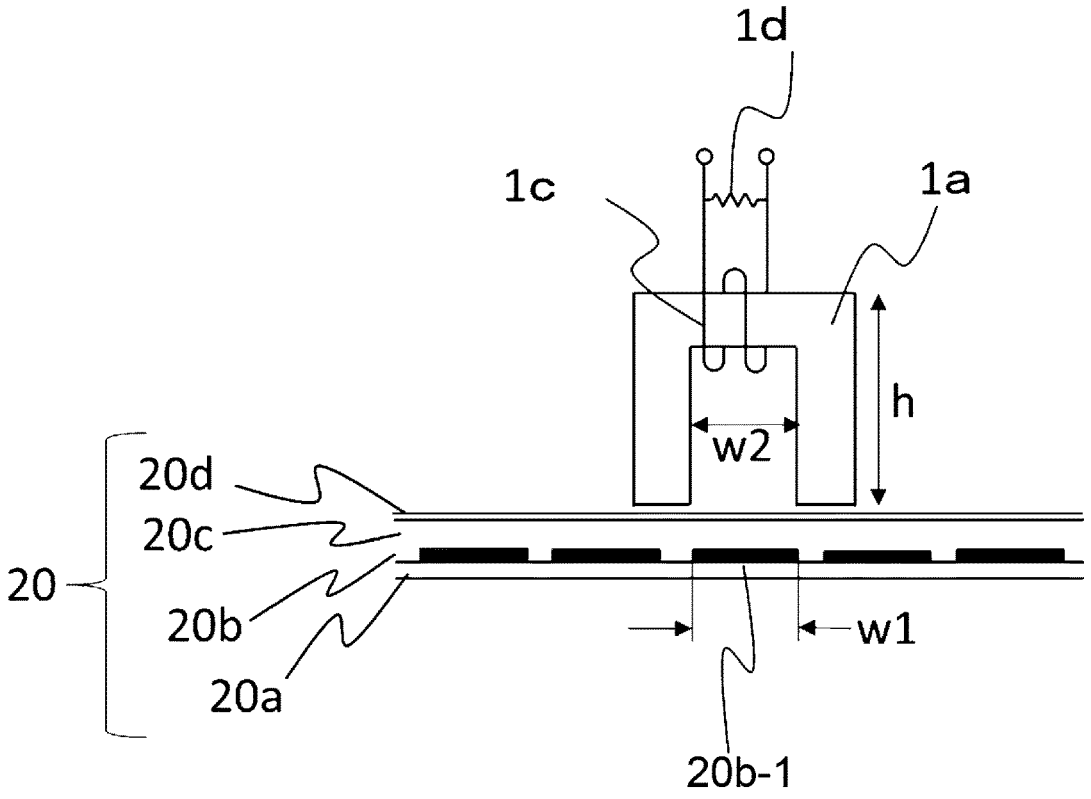

FIG. 10 is a sectional view showing a structure of a current monitoring sensor in a first embodiment.

Figure 11:
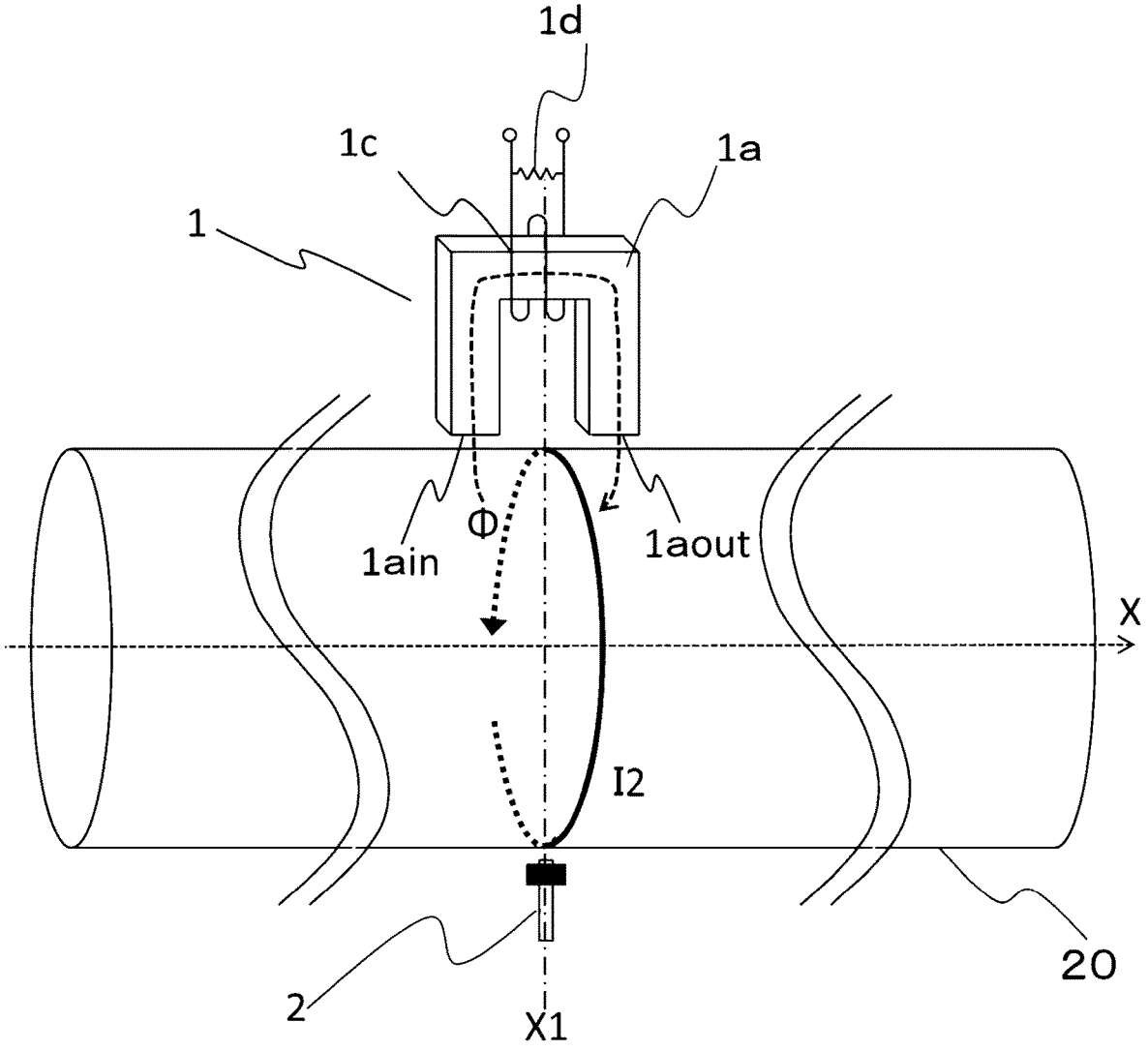

FIG. 11 is a perspective view representing that magnetic flux generates by a circumferential current.

Figure 12:
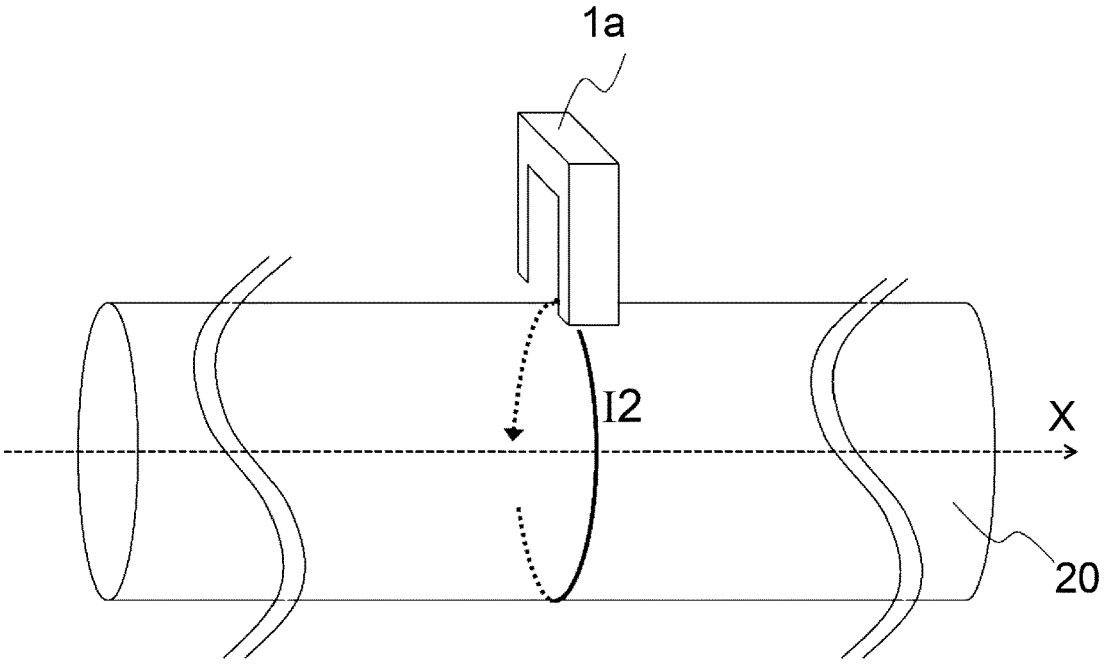

FIG. 12 is a perspective view in the case when a magnetic core is provided in parallel to a circumferential direction of a fixing sleeve.

Figure 13:
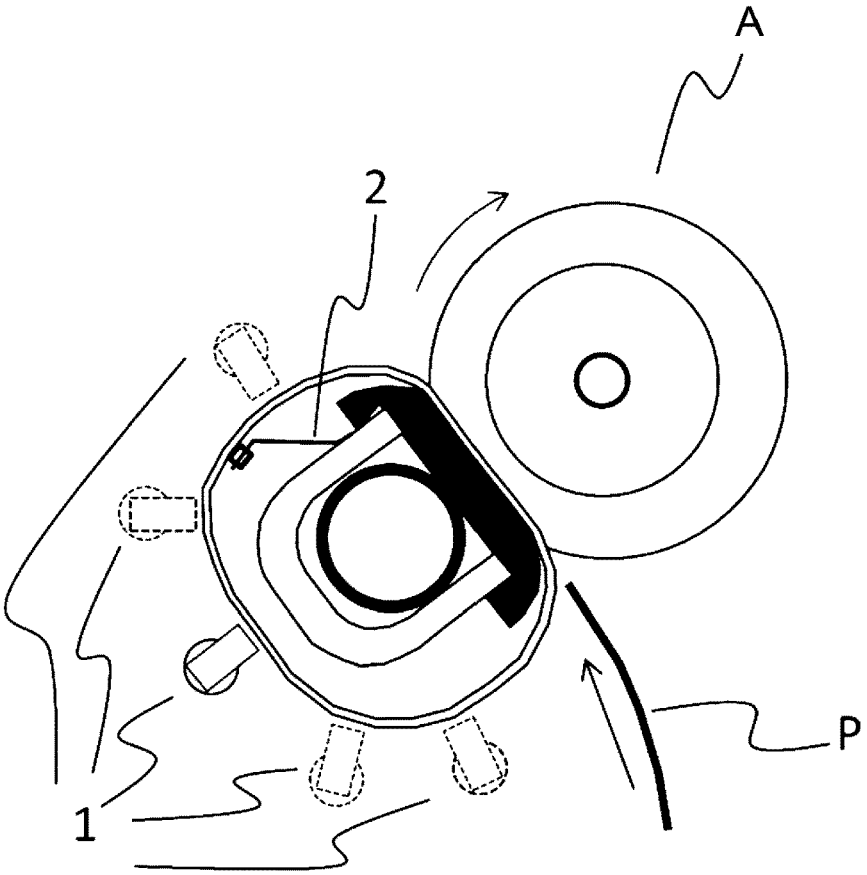

FIG. 13 is a sectional view showing a position of the current monitoring sensor as seen in a longitudinal direction of the rotatable member.

Figure 14:
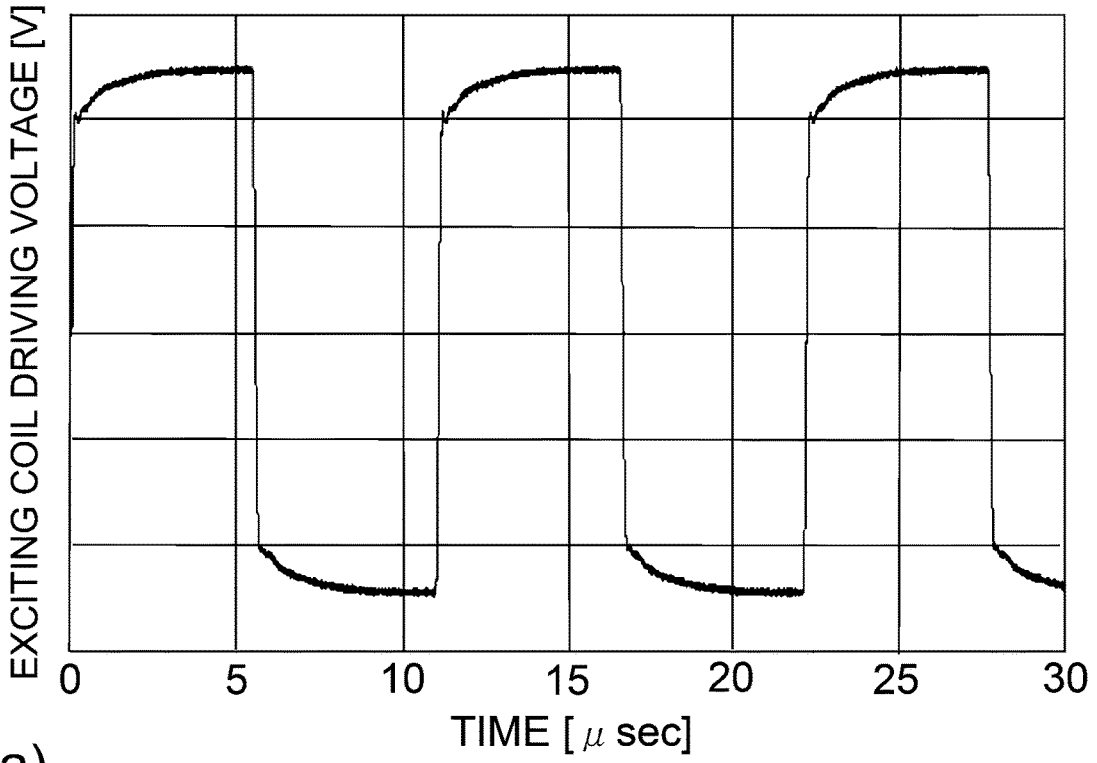
Figure 14:
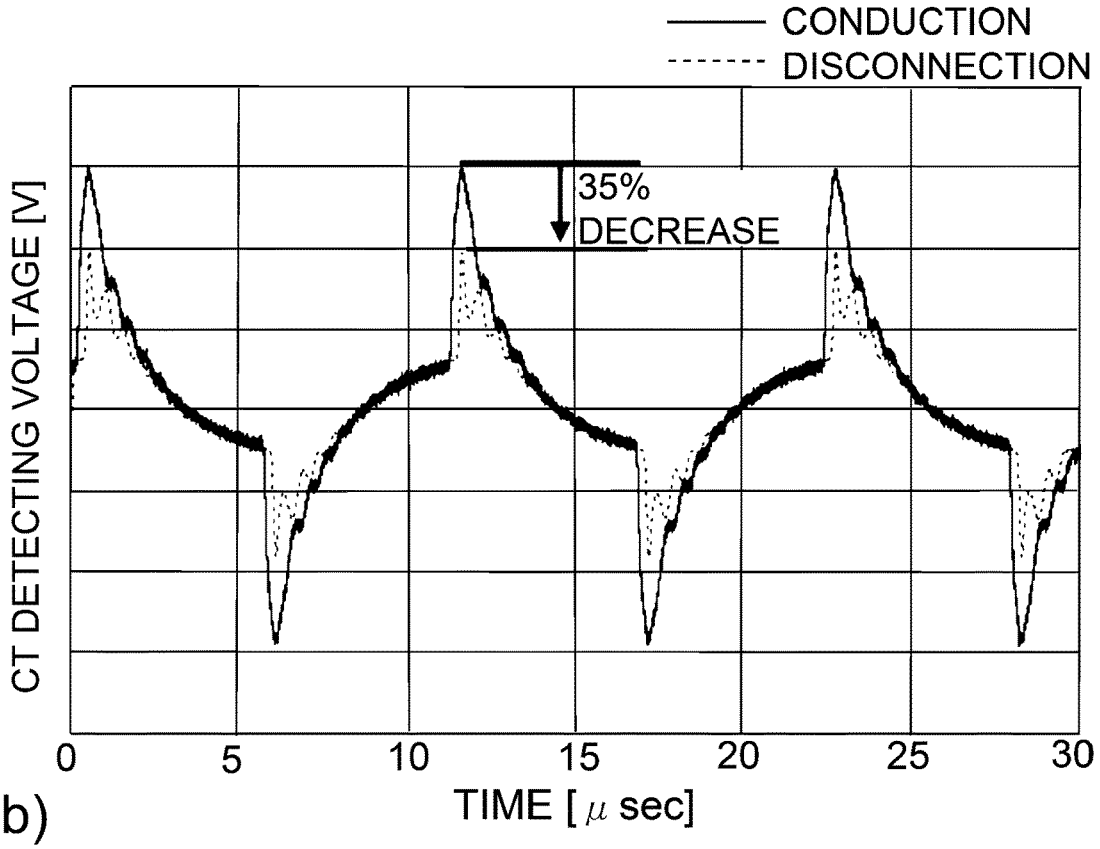

Parts (a) and (b) of FIG. 14 are diagrams showing voltage waveforms in the first embodiment.

Figure 15:
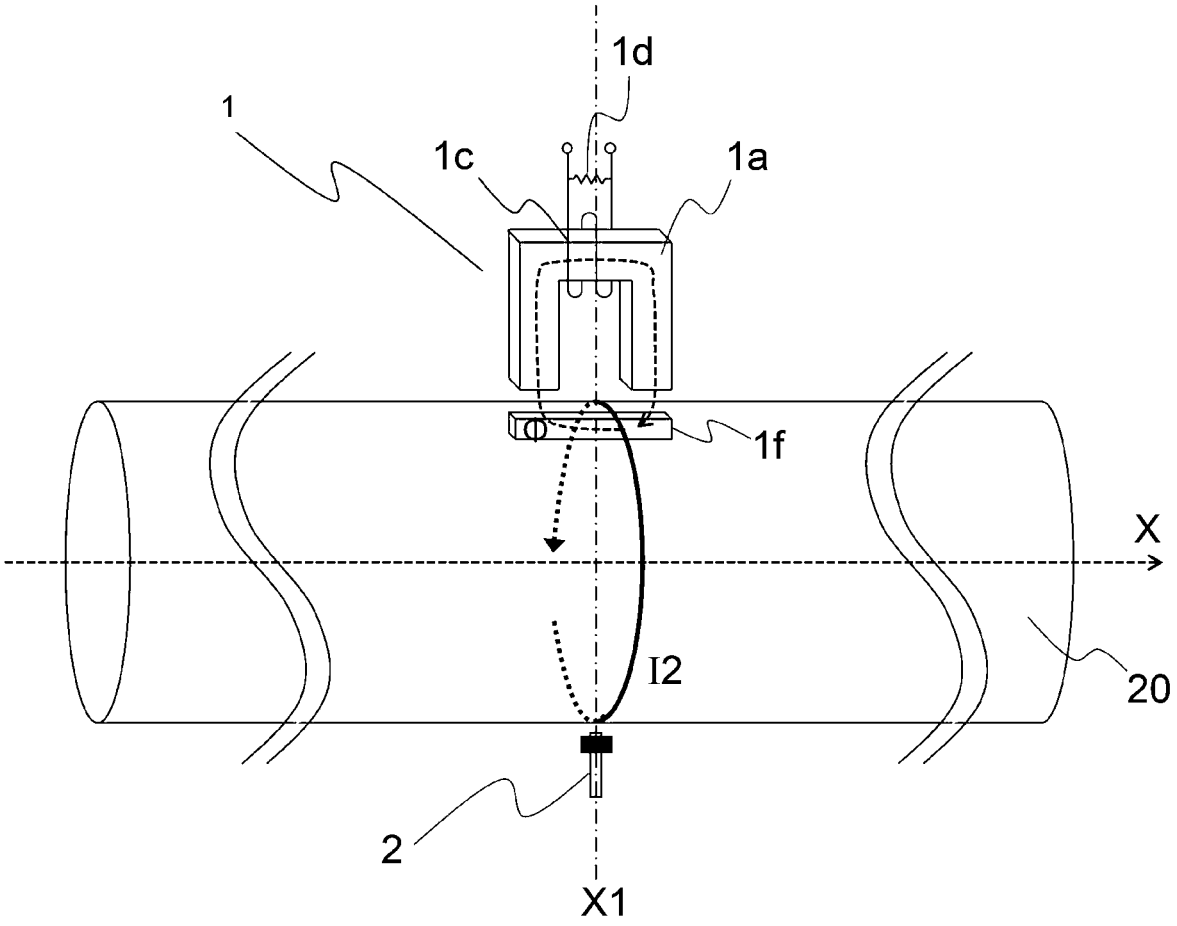

FIG. 15 is a diagram showing a structure of a current monitoring sensor in a second embodiment.

Figure 16:
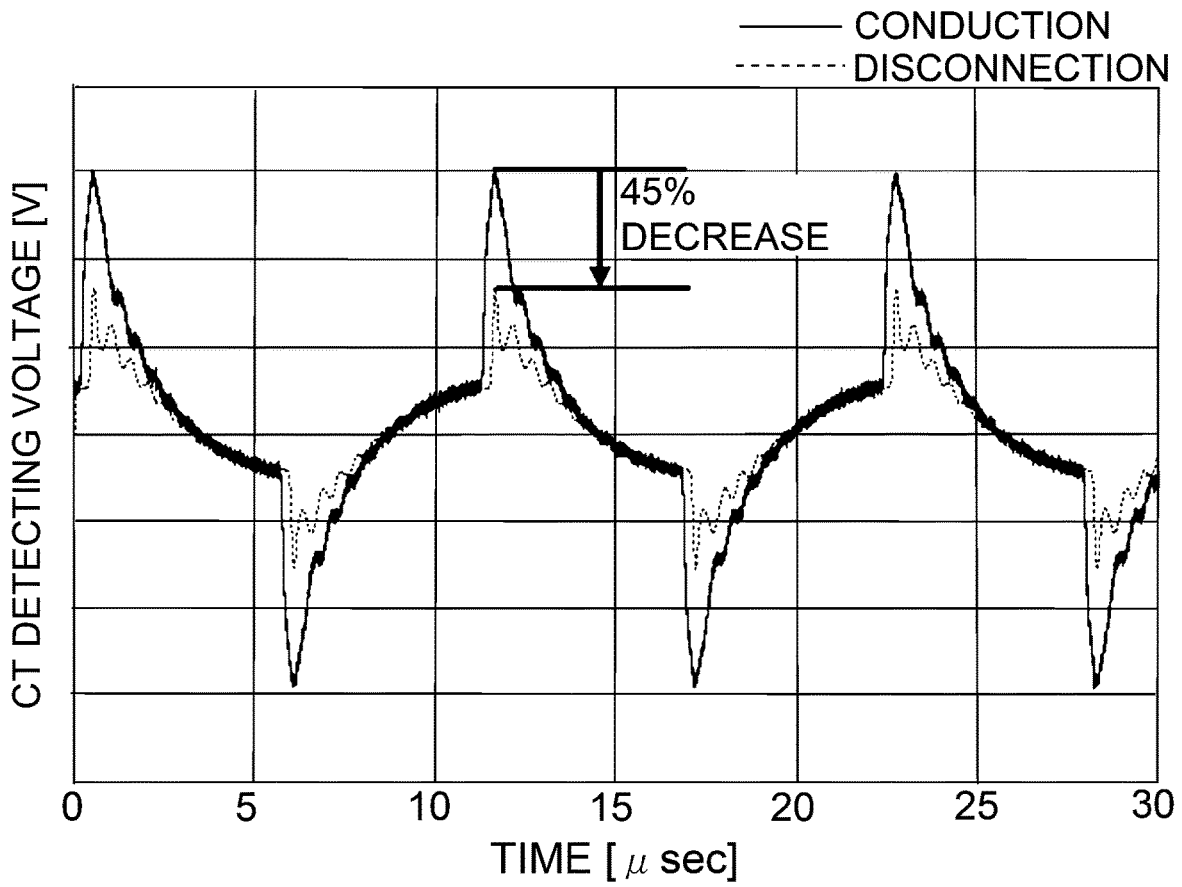

FIG. 16 is a diagram showing a voltage waveform in the second embodiment.

Figure 17:
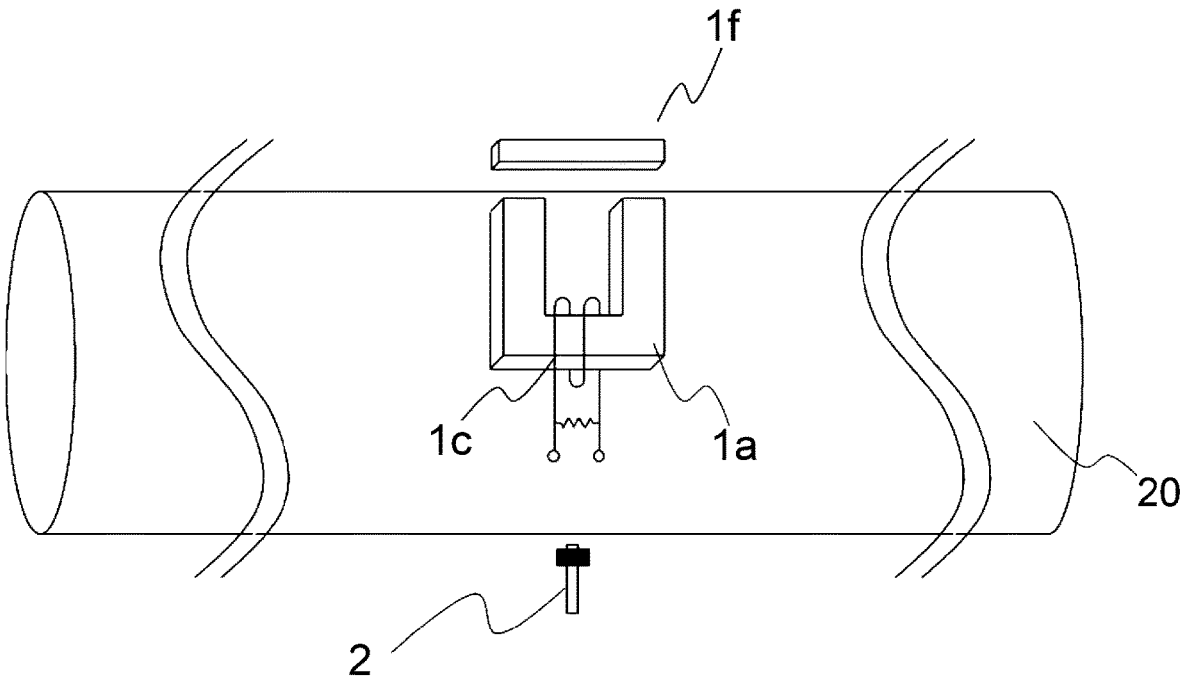

FIG. 17 is a diagram showing a structure of a current monitoring sensor in the second embodiment.

Figure 18:
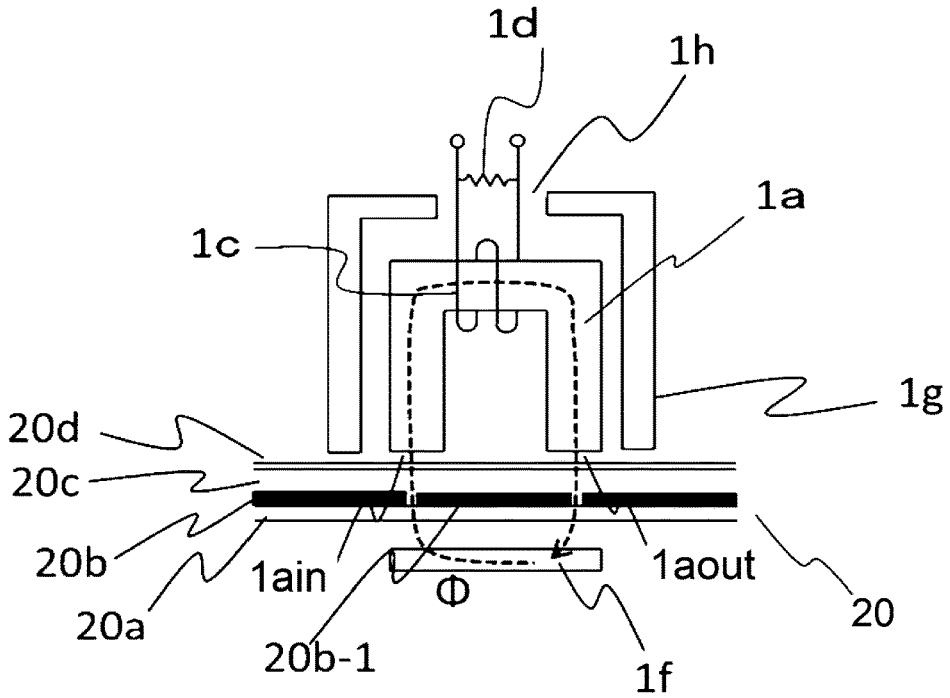
Figure 18:
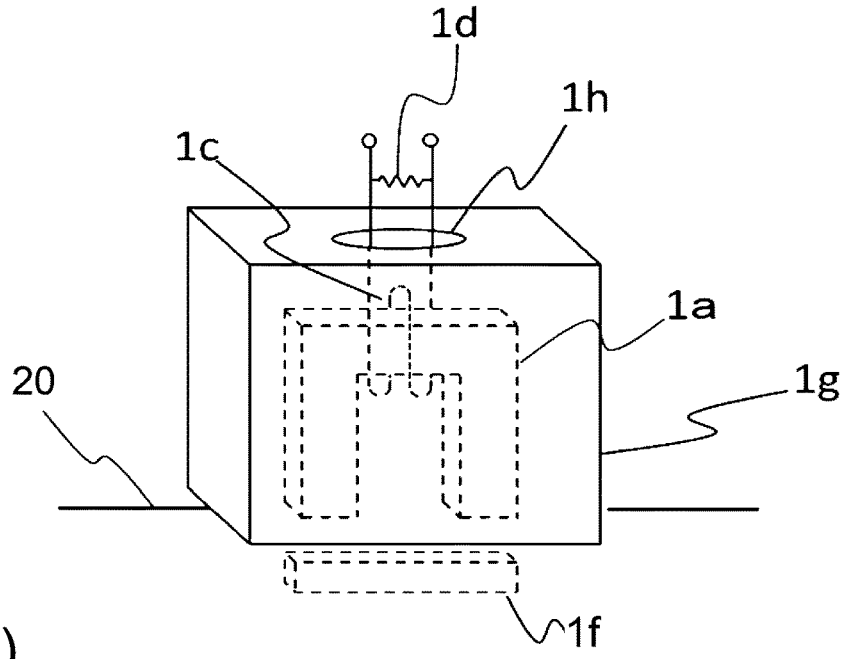

Parts (a) and (b) of FIG. 18 are diagrams showing a structure of a current monitoring sensor in a third embodiment.

Figure 19:
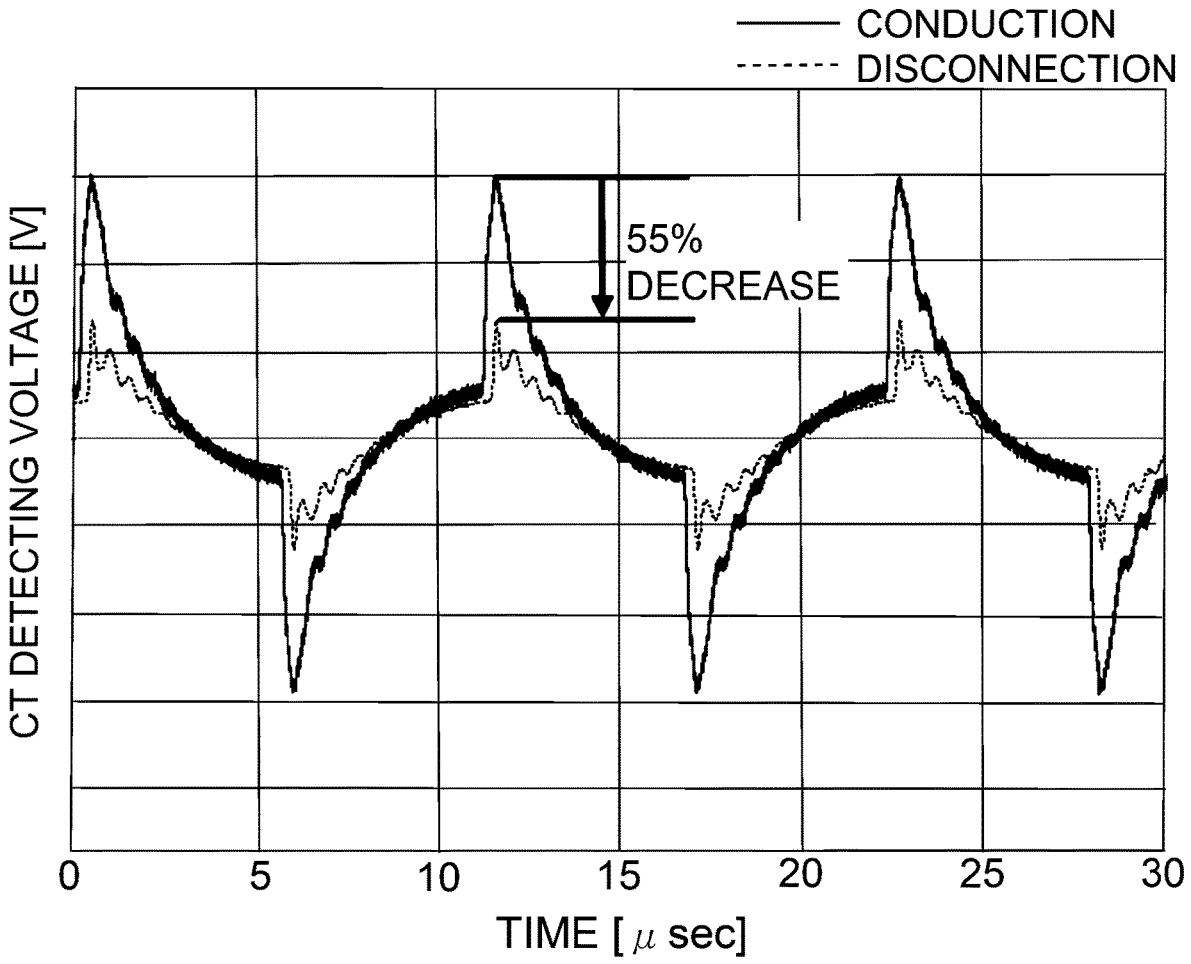

FIG. 19 is a diagram showing a voltage waveform in the third embodiment.

Figure 20:
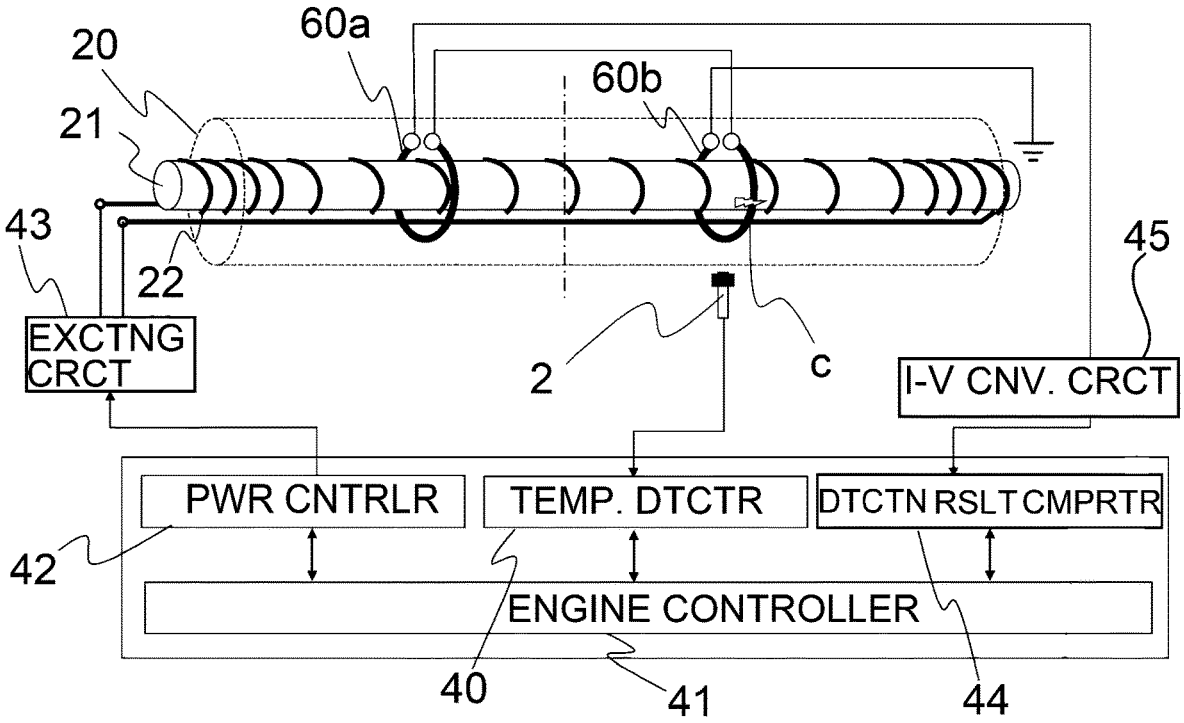

FIG. 20 is a diagram showing a structure of a current monitoring sensor in a fourth embodiment.

Figure 21:
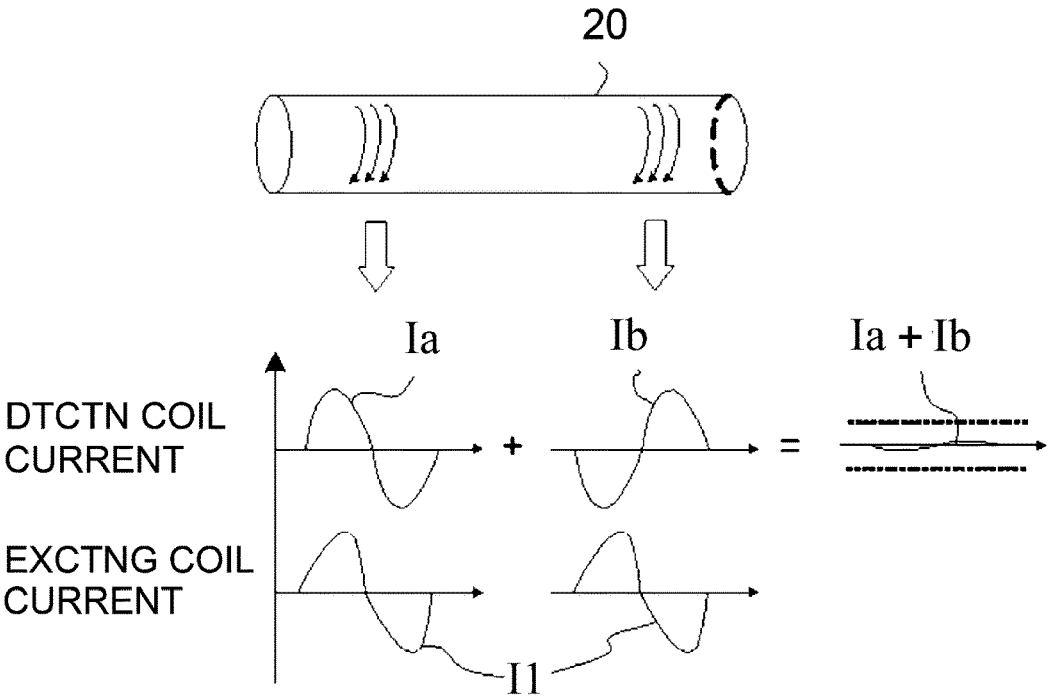
Figure 21:
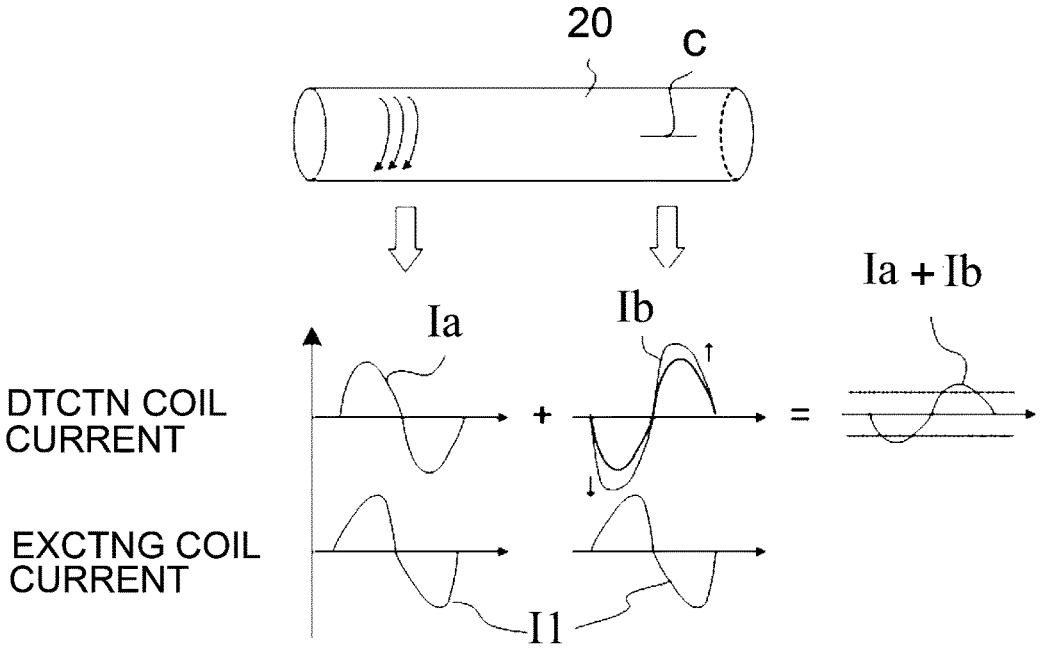

Parts (a) and (b) of FIG. 21 are diagrams showing voltage waveforms in the fourth embodiment.

Figure 22:
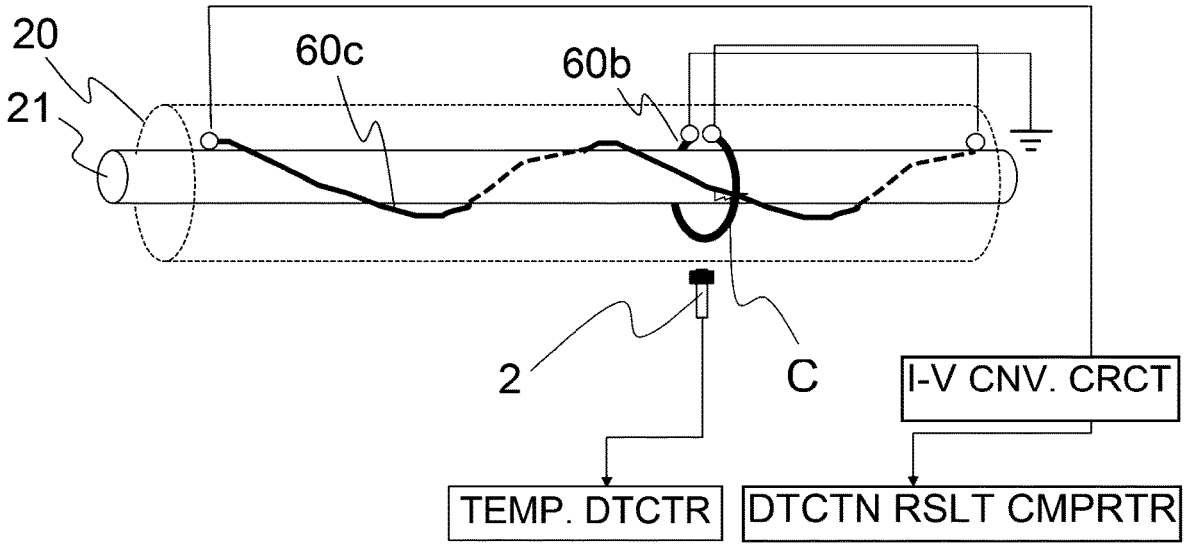

FIG. 22 is a diagram showing another structure of the current monitoring sensor in the fourth embodiment.

Figure 23:
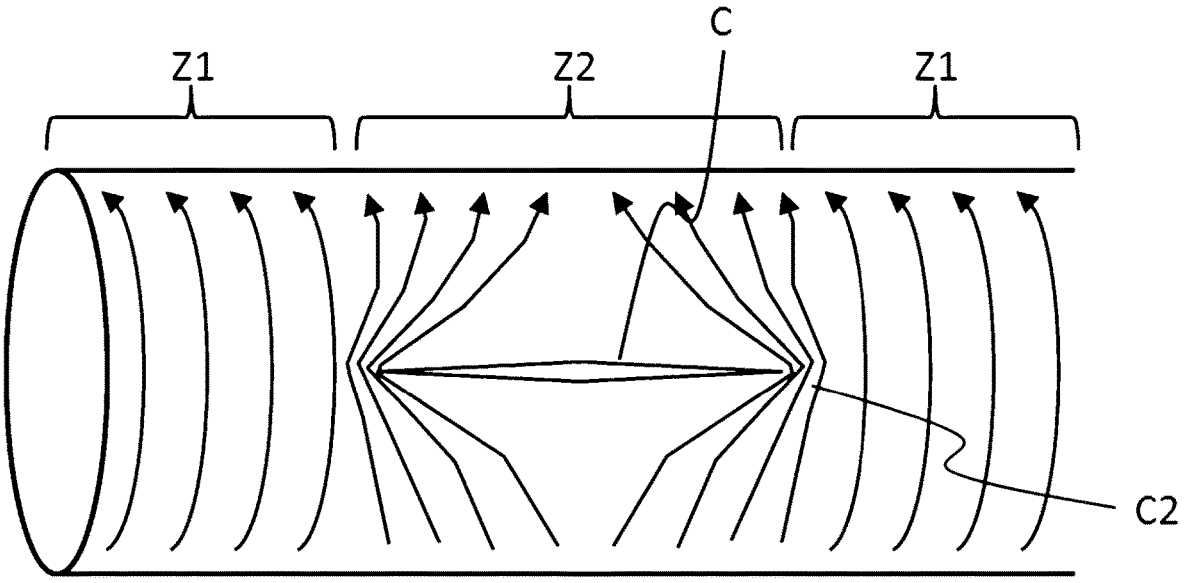
Figure 23:
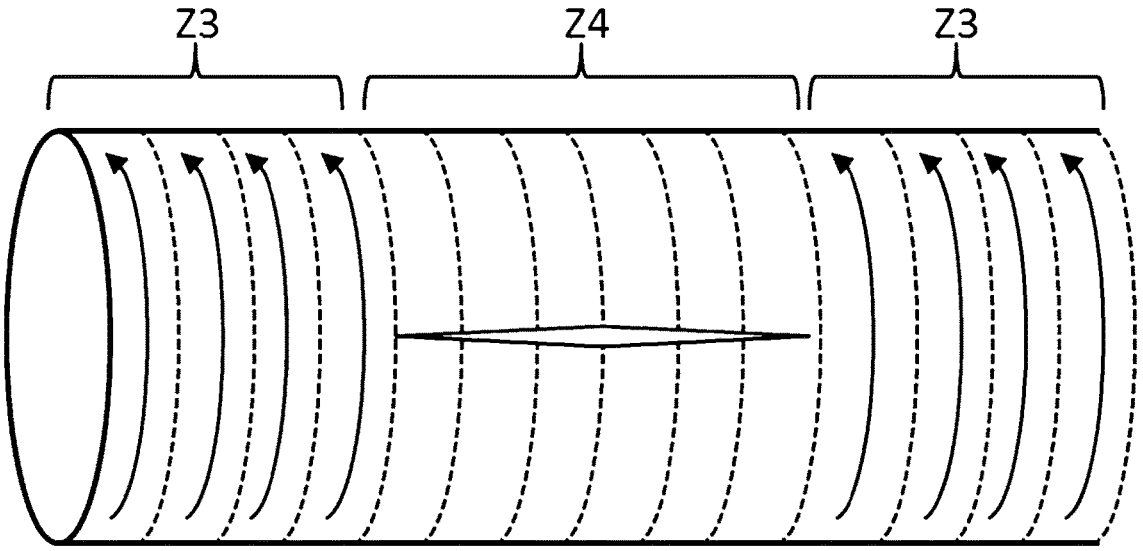

Parts (a) and (b) of FIG. 23 are schematic views showing currents when cracks occur in heat generating patterns in the case when a heat generating layer is not divided with respect to a longitudinal direction and in the case when the heat generating layer is divided with respect to the longitudinal direction, respectively.

DESCRIPTION OF EMBODIMENTS

In the following, embodiments of the present invention will be described with reference to the drawings.

First Embodiment (Image Forming Apparatus)

Figure 1:
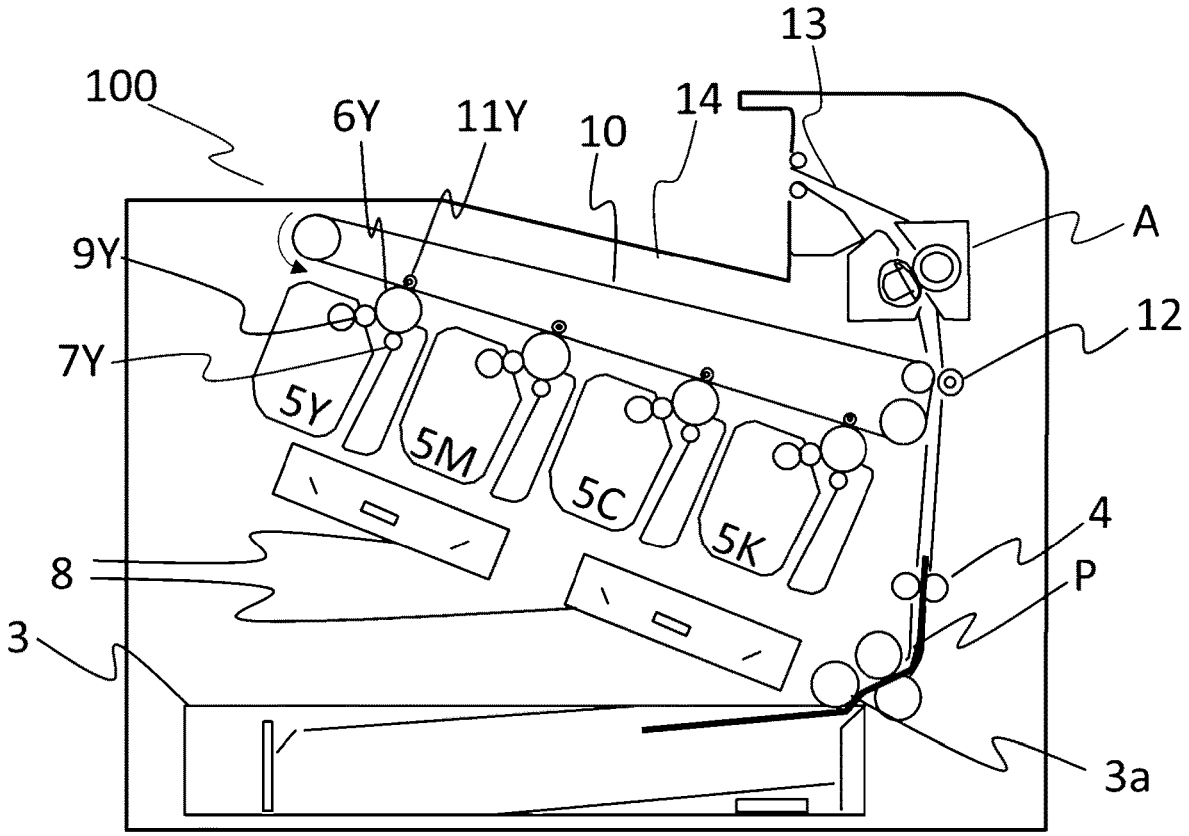
FIG. 1 is a cross-sectional view showing a general structure of an image forming apparatus in which an image heating apparatus according to an embodiment of the present invention is mounted.

First, an image forming apparatus, in which an image heating apparatus according to an embodiment of the present invention is mounted, will be described with reference to FIG. 1. The image forming apparatus shown in FIG. 1 is a full-color laser beam printer 100. At a lower portion of the printer 100, a cassette 3 is accommodated so as to be capable of being pulled out. In the cassette 3, sheets P of a recording material are stacked and accommodated. The sheets P are separated one by one by a separation roller 3*a*, and the separated sheet P is fed to a registration roller pair 4.

The printer 100 includes image forming stations (image forming portions) 5Y, 5M, 5C, and 5K that correspond to colors of yellow, magenta, cyan and black, respectively, and that are arranged obliquely in a line. The image forming portion 5Y includes a photosensitive drum 6Y, which is an image bearing member, and a charging means 7Y for electrically charging a surface of the photosensitive drum 6Y uniformly. A scanner unit 8 is provided below the image forming portion 5Y. The scanner unit 8 forms an electrostatic latent image on the photosensitive drum 6Y by irradiating the surface of the photosensitive drum 6Y with a laser beam on the basis of image information. The electrostatic latent image is developed into a toner image by depositing toner thereon by a developing means 9Y.

The toner image is transferred onto an intermediary transfer belt 10 at a primary transfer portion 11Y. The intermediary transfer belt 10 is rotationally driven in an arrow direction, and a similar step is performed in each of the image forming portions 5M, 5C, and 5K, so that the toner images are superposed on each other. The superposed toner images are transferred onto the sheet P at a secondary transfer portion 12 and pass through an image heating apparatus A, so that a fixed image is formed on the sheet P. The sheet P passes through a discharge feeding portion 13 and is discharged and stacked on a stacking portion 14.

(Image Heating Apparatus)

Figure 2:
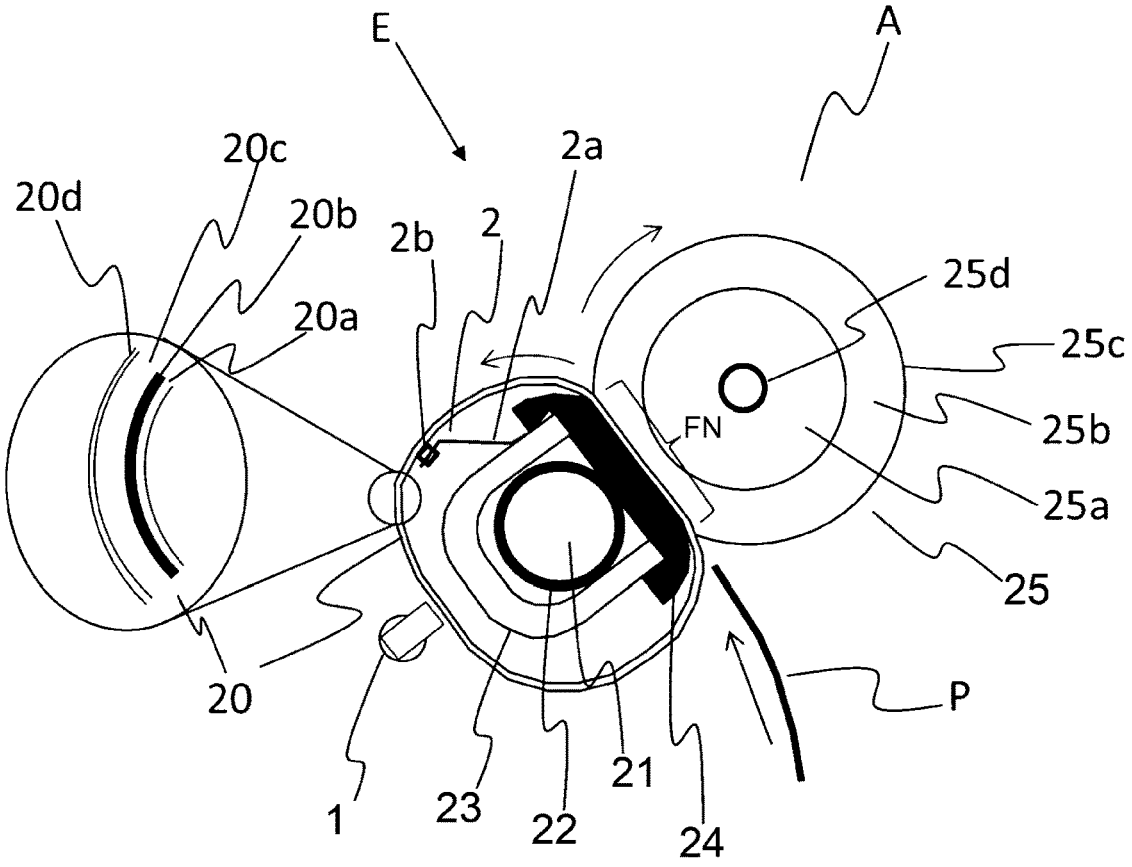
FIG. 2 is a cross-sectional view of a principal part of the image heating apparatus according to the embodiment.
Figure 3:
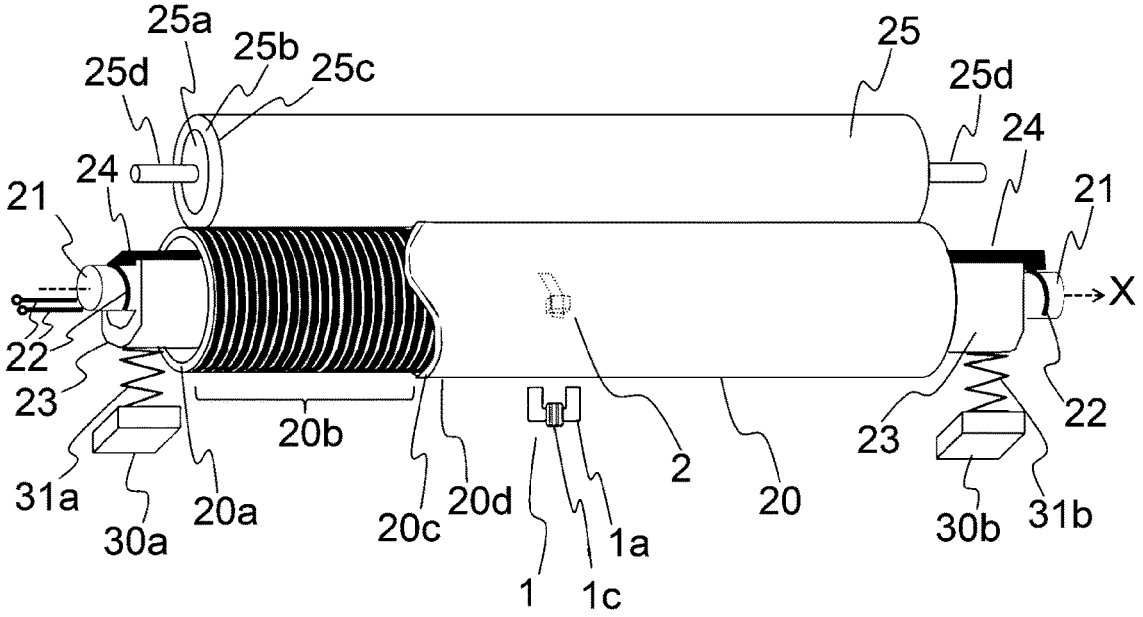
FIG. 3 is a front view of the principal part of the image heating apparatus according to the embodiment as seen in an arrow E direction in FIG. 2.

The image heating apparatus A, according to this embodiment of the present invention, is a fixing device of an electromagnetic induction heating type. FIG. 2 is a cross-sectional side view of a principal part of the image heating apparatus A of this embodiment, and FIG. 3 is a front view of the principal part of the image heating apparatus A as seen in an arrow E direction in FIG. 2. In FIG. 3, a portion of a fixing sleeve 20 is omitted a longitudinal direction of the fixing sleeve 20 in order to illustrate a layer structure. Here, as regards members constituting the image heating apparatus A, the longitudinal direction refers to a direction perpendicular to a recording material feeding direction and a recording material thickness direction.

In this embodiment, as shown in part (a) of FIG. 4, a heat generating pattern 20*b* consisting of a plurality of ring-shaped divided heat generating layers 20*bd* is formed in the in the fixing sleeve 20. The divided heat generating layers 20*bd* are electrically divided portions with respect to the longitudinal direction of the fixing sleeve 20. By such a shape of the heat generating pattern 20*b*, a flowing direction of an induced current is limited to a circumferential direction (circulating direction), so that when a crack occurs in the heat generating pattern 20*b*, it is possible to suppress an amount of a current flowing while detouring around the crack. As a result, it is possible to avoid a problem where the current concentrates and results in a locally large heat generation amount.

Incidentally, the plurality of divided heat generating layers 20*bd* in the heat generating pattern 20*b* do not need to be electrically divided with each other as shown in part (a) of FIG. 4 but may also be partially connected by a connecting portion 20*b*-2 as shown in part (b) of FIG. 4. Thus, the divided heat generating layers 20*bd* of the heat generating pattern 20*b* may have a shape such that at least a part thereof is divided with each other with respect to the circumferential direction of the fixing sleeve 20.

In this embodiment, as seen in the longitudinal direction of the fixing sleeve 20, a nip FN is formed between the fixing sleeve 20 and a pressing roller 25 by a film guide 24 as a nip-forming member (FIG. 2). The toner image on the recording material is heated in the nip FN, with the result that the toner image on the recording material is fixed as a fixed image on the recording material.

A magnetic core 21 is inserted into the fixing sleeve 20 in an axial direction (as indicated by the arrow of an X axis in FIG. 3), and an exciting coil 22 is formed by being wound around an outer periphery of the magnetic core 21 in a helical shape (a helical axis is substantially parallel to the X axis). By passing an alternating current through the exciting coil 22, the exciting coil 22 generates an alternating magnetic field, and the magnetic core 21 induces its magnetic lines of force (magnetic flux) to an inside of the fixing sleeve 20 and has the function of forming a path (magnetic path) of the magnetic lines of force.

In the image heating apparatus A of this embodiment, a current monitoring sensor 1 and a thermistor 2 are further provided. The current monitoring sensor 1 is conduction monitoring means of the heat generating layer of the fixing sleeve 20. The thermistor 2 senses (detects) abnormal temperature rise of the fixing sleeve 20. The thermistor 2 may be used for shutting off energization to the exciting coil 22, as described later. The thermistor 2 functions as a first element used for detecting the abnormal temperature rise and for shutting off the energization to the exciting coil 22.

Further, although specifically described later, the current monitoring sensor 1 monitors whether the divided heat generating layer 20*bd* is not broken and is electrically conducted or the divided heat generating layer 20*bd* is broken and is not electrically conducted. The current monitoring sensor 1 functions as a second element used for shutting off energization to the exciting coil.

In the following, respective members relating to this embodiment will be specifically described.

(Fixing Sleeve)

The fixing sleeve 20 in this embodiment is flexible cylindrical member (cylindrical rotatable member). The fixing sleeve used in this embodiment is a fixing film that is 30 mm in inner diameter and 235 mm in length, with respect to the longitudinal direction. On an about 60 μm-thick polyimide base layer 20*a*, an about 5 μm-thick heat generating pattern 20*b* is provided as a heat generating layer. Further, on the heat generating pattern 20*b*, an about 200 μm-thick elastic layer 20*c* of a silicone rubber, a fluorine-containing rubber or the like, and an about 15 μm-thick parting layer 20*d* of a PFA resin tube, as an outermost layer, are provided.

Regarding the heat generating pattern 20*b*, each of rings (divided heat generating layers 20*bd*) is about 3 mm in width, with respect to the longitudinal direction of the fixing sleeve, and is about 0.1 mm in interval between adjacent rings. The heat generating pattern 20*b* is formed in an entire region of the fixing sleeve 20 with respect to the longitudinal direction. The heat generating pattern 20*b* is formed by means of printing, plating, sputtering, vapor deposition, or the like, and in this embodiment, the heat generating pattern 20*b* is formed by subjecting silver ink to screen printing. Further, although the heat generating pattern 20*b* is electrically divided with respect to the longitudinal direction of the fixing sleeve 20, the heat generating pattern 20*b* is formed in an electrically connected ring shape in a 360° regional direction with respect to a circumferential direction.

(Pressing Roller)

A pressing roller 25 is an opposing member that opposes the fixing sleeve 20. The pressing roller 25 includes a core metal 25*a*, an elastic layer 25*b*, and a parting layer 25*c*. The elastic layer 25*b* molded and coated in a roller shape concentrically around the core metal 25*a*. The parting layer 25*c* is provided as a surface layer. The elastic layer 25*b* may preferably be formed of a material, having a good heat-resistant property, such as a silicone rubber, a fluorine-containing rubber or a fluorosilicone rubber.

The core metal 25*a* includes shafts 25*d*. The shafts 25*d* are provided at opposite end portions of the core metal 25*a*, with respect to the longitudinal direction. The shafts 25*d* are freely held (supported) by chassis (not shown) of the fixing device through bearings. A pressing stay 23 has a function of reinforcing a film guide 24 made of a resin material. The pressing stay 23 is made of a resin material. The film guide 24 contacting the pressing stay 23 forms a fixing nip FN in cooperation with the pressing roller 25 between the fixing sleeve 20 and the pressing roller 25. In FIG. 2, when the pressing roller 25 is rotationally driven in the clockwise direction in the figure by an unshown driving means, the fixing sleeve 20 is rotated in an arrow direction (counter-clockwise direction) by a frictional force with an outer surface of the fixing sleeve 20 and is capable of nipping and feeding the sheet P while heating sheet P in the nip FN.

Incidentally, in the opposite end portions of the above-described pressing stay 23, a pressing force (pressure) of about 100 N-250 N (about 10 kgf-about 25 kgf) in total pressure is applied to the pressing stay. The pressing force is applied by providing pressing springs 31*a* and 31*b*, in compression, between the pressing stay 23 and a device chassis-side spring receiving member 30*a* and between the pressing stay 23 and a device chassis-side spring receiving member 30*b*, respectively.

(Magnetic Field Generating Means)

Into a hollow portion of the fixing sleeve 20, as a first magnetic core for inducing magnetic lines of force of an alternating means filed, a cylindrical magnetic core 21 of 15 mm in diameter and 250 mm in length is inserted. The magnetic core 21 is constituted by a material small in hysteresis loss and high in specific permeability, for example, by a high-permeability soft magnetic material (member) such as sintered ferrite or a ferrite resin material.

Around an outer periphery of the magnetic core 21, a copper wire material (single lead wire) which is coated with heat-resistant polyamideimide and which is 1-2 mm in diameter is wound in a coil shape and constitutes the exciting coil 22. In FIG. 2, the pressing stay 23 is made of non-magnetic stainless steel, and the film guide 24 is constituted by a heat-resistant resin material such as PPS and also functions as the nip-forming member as described above.

(Thermistor)

In FIG. 2, the thermistor 2, as a temperature detecting member, is provided by being fixed to the film guide 24. The thermistor 2 includes a spring plate 2*a*, as a supporting member, and a thermistor element 2*b* provided at a free end portion of this spring plate 2*a*. Spring plate 2*a* extends toward an inner surface of the fixing sleeve 20 and has spring elasticity. The thermistor element 2*b* is urged against the inner surface of the fixing sleeve 20 by the elasticity of the spring plate 2*a*. The thermistor element 2*b* is thus held in a contact state and measures an inner surface temperature of the fixing sleeve 20.

The thermistor 2 is provided inside the fixing sleeve 20 (indicated by a dotted line in FIG. 3) and monitors the inner surface temperature of the fixing sleeve 20 at a central portion with respect to an X-axis direction. Further, the current monitoring sensor 1 as a conduction monitoring means for monitoring electric conduction of the divided heat generating pattern 20*b* and the thermistor 2 for detecting the temperature of the fixing sleeve 20 are disposed at the same position with respect to the longitudinal direction (X-axis direction) of the fixing sleeve 20.

(Heating Principle of Fixing Sleeve)

FIG. 5 is a schematic view of a magnetic field at a periphery of the magnetic core 21 and an induced current induced in the heat generating pattern 20*b*. The magnetic core 21 forms a path (magnetic path) of magnetic lines of force with respect to the X-axis direction of the fixing sleeve 20. The number of windings of the exciting coil 21 around the magnetic core 21 is about 15-25 (times). At the instant when a current increases in a direction of an arrow I1 on the exciting coil 22, the magnetic core 21 induces the magnetic lines of force indicated by dotted lines B in FIG. 5. A change in this magnetic field induces a current into the heat generating pattern 20*b* of the fixing sleeve 20. The heat generating pattern 20*b* generates Joule heat by the induced current.

A divided heat generating layer 20*b*-1 is one of many divided heat generating layers 20*bd* arranged. A heat generation principle is in conformity with the Faraday's law. Induced electromotive force V causing the current to pass through a circuit of the divided heat generating layer 20*b*-1 is proportional to a change of time of magnetic flux perpendicularly penetrating the circuit. The induced electromotive force V is represented by the following formula (1). The induced electromotive force V is proportional to the product of a change Δφ/Δt of the magnetic flux perpendicularly penetrating the divided heat generating layer 20*b*-1 in a minute time Δt and the number of winding N.

$$V = -N\frac{\Delta\Phi}{\Delta t}$$

V: induced electromotive force

N: the number of windings of coil

ΔΦ/Δt: change of magnetic flux perpendicularly penetrating circuit in minute time Δt By this induced electromotive force V, the current is caused to flow in the case when the divided heat generating layer 20*b*-1 is connected with respect to the circumferential direction (circulating direction) of the fixing sleeve 20, so that Joule heating is caused. On the other hand, in the case when the divided heat generating layer 20*b*-1 is not connected with respect to the circumferential direction, the current does not flow and thus the Joule heating does not occur.

(Heating Control)

FIG. 6 is a schematic view for illustrating heating control by the thermistor 2. The ring-shaped heat generating pattern 20*b* is arranged over an entire region of the fixing sleeve 20 with respect to the longitudinal direction, so that entirety of the fixing sleeve 20 with respect to the longitudinal direction is heated. The thermistor 2 monitors the temperature of the fixing sleeve 20 at a central portion with respect to the longitudinal direction. Incidentally, in this embodiment, the thermistor 2 is provided inside the fixing sleeve 20, but in FIG. 6, the thermistor 2 is illustrated outside the fixing sleeve 20 in order to enhance viewability. The thermistor 2 is connected to a temperature detecting portion 40 and sends temperature information to an engine controller 41 on the basis of a detected temperature.

The engine controller 41 calculates electric power to be supplied to the fixing sleeve 20 and supplies a high-frequency current from an exciting circuit 43 to the exciting coil 22 through an electric power controller 42. As a result, a surface temperature of the fixing sleeve 20 is maintained and adjusted at a predetermined target temperature (about 150-200° C.).

Further, in the case when the thermistor 2 detects a temperature of a predetermined value (for example 220° C.) or more, the engine controller 41 determines that a high temperature abnormality has occurred and prohibits electric power from being supplied to the fixing sleeve 20 and thus stops the image forming operation.

(Measures During Breakage of Fixing Sleeve)

Here, as shown in FIG. 7, in the case when breakage C such as a crack occurs in the fixing sleeve 20, the divided heat generating layer 20*b*-1 does not generate the Joule heat. In that case, the thermistor 2 not only cannot maintain and adjust the surface temperature of the fixing sleeve 20 to a predetermined target temperature but also cannot function as the above-described energization shut-off element.

On the other hand, the current monitoring sensor 1 as the conduction monitoring means sends a voltage signal to a detection result comparing portion 44. The detection result comparing portion 44 determines that breakage occurs in the case when a predetermined voltage or less is detected and then sends a breakage detection signal to the engine controller 41. The engine controller 41, having received the breakage detection signal, prohibits the supply of the electric power and stops the image forming operation.

Incidentally, as shown in FIG. 8, in the case when the breakage C occurs in the divided heat generating layer different from the divided heat generating layer corresponding to the thermistor 2, there is a possibility that a broken portion becomes a low temperature compared with other portions and causes an image defect. However, the surface temperature of the fixing sleeve 20 can be maintained and adjusted to the predetermined target temperature, and therefore, there is no need to prohibit the supply of the electric power to the fixing sleeve 20.

(Conduction Monitoring Means)

A principle of the current monitoring sensor 1 as the conduction monitoring means will be specifically described. As described above, in this embodiment, a circumferential (circulating) current by the induced electromotive force flows in the heat generating pattern 20*b*. The induced electromotive force is proportional to the time change of magnetic flux φ generated by the exciting coil 22 as in the above-described formula. For that reason, the induced electromotive force V can be acquired by being measured by connecting a general-purpose current measuring circuit with the exciting coil 22 in series.

On the other hand, the circumferential current flowing in the heat generating pattern 20*b* cannot be measured by connecting the current measuring circuit in series. Therefore, a principle of current detection by a current transformer, which is a type of a non-contact current sensor, is applied. FIG. 9 is an illustration of the principle of the current detection by the current transformer. An alternating current I3 flowing in a measurement electroconductor 50 generates magnetic flux φ1 in a magnetic core 51. The generated magnetic flux φ1 induces a secondary current I4, depending on a winding number ratio, in a coil 52, and consequently generates magnetic flux φ2 in a direction of canceling the magnetic flux φ1.

The secondary current I4 generates a voltage between opposite terminals 54*a* and 54*b* of a shunt resistor 53. This voltage between the opposite terminals 54*a* and 54*b* is proportional to the alternating current I3 flowing in the measurement electroconductor 50, and therefore, the current (the alternating current I3 flowing in the measurement electroconductor) can be acquired by measuring of the voltage between the opposite terminals 54*a* and 54*b*.

Thus, in this embodiment, the current monitoring sensor 1, as a second element, is provided so as to cause a voltage change are a current change due to electromagnetic induction with breakage (disconnection) of the heat generating pattern.

Next, a specific structure of the current monitoring sensor 1, as the conduction monitoring means of, this embodiment will be described in detail. FIG. 10 is a sectional view showing a structure of the current monitoring sensor. Outside the fixing sleeve 20, a U-shaped magnetic core 1*a* (second magnetic core) for monitoring electric conduction, different from the magnetic core 21 (first magnetic core) for induction heating, is provided.

Further, a detection coil 1*c* is wound around the magnetic core 1*a*, and a shunt resistor 1*d* is connected to opposite terminals of the detection coil 1*c*. This structure is the same in principle as the current transformer type current sensor of FIG. 9 except that a magnetic path by the magnetic core is partially deficient compared with the current transformer type current sensor.

The detection coil 1*c* is disposed so that a helical axis thereof is substantially parallel to the helical axis (the X-axis direction of FIG. 11) of the exciting coil 22. The magnetic core 1*a* is disposed so that two leg portions constituting the U-shape are substantially parallel the helical axis of the exciting coil 22. With respect to the longitudinal direction of the fixing sleeve 20, a center position of the magnetic core 1*a* and a position of the thermistor 2 coincide with each other.

FIG. 11 is a perspective view representing that magnetic flux φ generates in a magnetic path formed by the magnetic core 1*a* is generated by a circumferential current 2 flowing in the fixing sleeve 20. By the principle of the above-described current transformer type current sensor, in the detection coil 1*c*, the alternating current depending on the winding number ratio of the detection coil 1*c* flows in the detection coil 1*c* so as to cancel the generated magnetic flux, so that a voltage generates at the opposite terminals of the shunt resistor 1*d*. This voltage is proportional to the circumferential current flowing in the fixing sleeve 20, and therefore, a current amount thereof can be discriminated.

A most important structural factor in the magnetic core 1*a* is a positional relationship between the circumferential current flowing in the fixing sleeve 20, and an inlet 1*a* in and an outlet 1*a* out of the magnetic flux of the magnetic core 1*a*. There is a need that the detection coil 1*c* is not wound around the inlet lain and the outlet 1*a*out and thus the inlet lain and the outlet 1*a*out are exposed magnetically. Further, the inlet lain and the outlet 1*a*out of the magnetic flux may desirably be in a positional relationship in which they oppose each other so that the current I2 to be monitored in interposed therebetween.

In FIG. 10, a width W1 of the divided heat generating layer 20*b*-1 and a width W2 between the two leg portions of the magnetic core 1*a* may preferably be the same as each other. In this embodiment, the width W1 of the divided heat generating layer 20*b*-1 is set at 3 mm, and the width W2 of the magnetic core 1*a* is set at 3 mm. The magnetic core 1*a* has a thickness (length with respect to a direction perpendicular to the drawing sheet of FIG. 10) of 2 mm and a height h of 5 mm.

Further, the detection coil 1*c* was 50 (times) in the number of winding and 1 kΩ in magnitude of the shunt resistor 1*d*. Incidentally, as shown in FIG. 12, when the magnetic core 1*a* is disposed in parallel to the circumferential direction of the fixing sleeve 20, only a little amount of the current flows in the detection coil, and thus, the current monitoring sensor 1 does not perform the current detecting function.

The function of the current monitoring sensor 1 as the conduction monitoring means in this embodiment is to discriminate whether the divided heat generating layer 20*b*-1 is normal or broken at the position where the thermistor 2 detects the surface temperature of the fixing sleeve 20.

Accordingly, as shown in FIG. 11, when a center position of the thermistor 2 with respect to the longitudinal direction (X-axis direction) of the fixing sleeve 20 is X1, there is a need to establish a positional relationship in which the inlet lain and the outlet 1*a*out of the magnetic flux oppose each other so as to sandwich the center position X1 therebetween. Incidentally, as regards a direction perpendicular to the X-axis, i.e., the circumferential direction of the fixing sleeve 20, there is no particularly necessary condition, so that the current monitoring sensor 1 can be provided at any circumferential direction as indicated by broken lines of FIG. 13.

(Check Result)

Part (a) of FIG. 14 shows a waveform of a driving voltage when a driving current of 90 kHz is caused to pass through the exciting coil 22 from the exciting circuit 43, the driving voltage is a rectangular voltage of about 11 μsec in cyclic period. An alternating magnetic field generating with this voltage causes the heat generating pattern of the fixing sleeve 20 to generate the induced electromotive force. Part (b) of FIG. 14 shows a voltage waveform applied to the opposite terminals of the shunt resistor 1*d* (FIG. 11) of the current monitoring sensor 1. A solid line represents the voltage waveform in the case when there is no breakage in the heat generating pattern of the fixing sleeve 20, and a broken line represents the voltage waveform in the case when breakage occurs in the heat generating pattern of the fixing sleeve 20.

The voltage exerted on the opposite terminals of the shunt resistor 1*d* is decreased by 35% in the case when disconnection occurs due to the breakage compared with the case when the heat generating pattern of the fixing sleeve 20 is connected with respect to the circumferential direction (in the case when there is no disconnection due to the breakage). The above-described analog voltage signal is sent to the detection result comparing portion 44. The detection result comparing portion 44 analyzes the sent analog voltage signal, and for example, program is made so that the disconnection due to the breakage is recognized when the voltage value is decreased by 25% or more than the voltage value during normal operation stored in an unshown memory.

As described above, the current monitoring sensor 1 detects the voltage exerted on the opposite terminals of the shunt resistor 1*d*, and a difference between the detected voltage value and a voltage value in the case when there is no disconnection due to the breakage is detected by the detection result comparing portion 44, whereby the detection result comparing portion 44 discriminates occurrence or non-occurrence of the breakage due to the heat generating pattern of the fixing sleeve 20. The detection result comparing portion 44 is capable of sending a breakage detection signal to the engine controller 41. As a result, the engine controller 41 is capable of stopping supply of the electric power to the fixing sleeve with reliability.

Incidentally, in this embodiment, the thermistor 2 as the energization shut-off element (first element) for shutting off the supply of the electric power when abnormal temperature rise was described, but it is possible to use a thermo-switch having a constitution in which the current is shut off by inversion of bimetal at a predetermined temperature. Or, it is also possible to use a thermal fuse or the like capable of shutting off the current by operation of a spring mechanism by melting a pellet.

Second Embodiment

A difference of a second embodiment of the present invention from the first embodiment is that a magnetic core is added to an inside of the fixing sleeve 20, and has a constitution in which detection accuracy is further improved. In the following, a current monitoring sensor 1 as the conduction monitoring means will be specifically described.

FIG. 15 is a perspective view showing a structure of the current monitoring sensor 1 in this embodiment. A magnetic core 1*f* is provided inside the fixing sleeve 20. Structures of other members such as the magnetic core 1*a*, the detection coil 1*c* and the shunt resistor 1*d* are the same as those in the first embodiment. When compared with the current transformer type current sensor, similarly as in the first embodiment, the constitution of this embodiment is such that the magnetic path is partially deficient. However, compared with the first embodiment, a degree of deficiency is small, so that the constitution closer to the magnetic path of the current transformer type current sensor is employed.

As a result, the current monitoring sensor 1 is capable of grasping the change of the magnetic flux φ due to the circumferential current I2 more reliably.

(Check Result)

FIG. 16 shows a waveform of a voltage applied between opposite terminals of the shunt resistor 1*d* of the current monitoring sensor 1 in this embodiment. A solid line represents the voltage waveform in the case when there is no breakage in the heat generating pattern of the fixing sleeve 20, and a broken line represents the voltage waveform in the case when the breakage occurs in the heat generating pattern of the fixing sleeve 20. In the case when the breakage occurs, the current does not flow and a signal of the current monitoring sensor 1 becomes small, so that a voltage value decreases by 45%.

As described above, by adding the magnetic core to the inside of the fixing sleeve 20, a constitution in which the degree of the deficiency of the magnetic path by the magnetic core is small is provided, so that detection accuracy is improved and reliability is enhanced.

As described above, in this embodiment, the example in which similarly as in the first embodiment, as the current monitoring sensor 1, the principle of the current transformer type current sensor including the magnetic core was described. Incidentally, in principle, as shown in FIG. 17, the magnetic core 1*a* and the detection coil 1*d*, and the magnetic core 1*f* may also be replaced between the outside and the inside relative to the constitution of FIG. 15.

Third Embodiment

A difference of this embodiment from the first embodiment and the second embodiment is that a magnetic shield 1*g* as a magnetic shield member surrounding the magnetic core 1*a* is added. A constitution of this embodiment is a constitution in which detection accuracy is further improved. In the following, a current monitoring sensor (device) 1 in this embodiment will be specifically described.

Parts (a) and (b) of FIG. 18 are a sectional view and a perspective view, respectively, showing a structure of a current monitoring device. The magnetic shield 1*g* is disposed so as to surround the magnetic core 1*a* and the detection coil 1*c*, and a side where the inlet lain and the outlet 1*a*out are provided is an opening, so that incidence of the magnetic flux φ is not prevented. Further, the magnetic shield 1*g* is provided with an opening 1*h* on an upper surface side of the figure, and wiring is guided from the detection coil 1*c* through the opening 1*h*. Structures of other members such as magnetic cores 1*a* and 1*f*, the detection coil 1*c* and the shunt resistor 1*d* are the same as those in the second embodiment.

A material of the magnetic shield 1*g* may desirably be constituted by low-resistance metal, such as aluminum or copper, as an electroconductive member, and may preferably have a thickness of 1 mm or more. The magnetic shield 1*g* is capable of suppressing noise entering through a portion other than the inlet lain and the outlet 1*a*out of the magnetic flux of the current monitoring sensor (device) 1. Accordingly, the constitution of this embodiment is capable of more reliably grasping the change of the magnetic flux φ due to the circumferential current I2, so that a difference between the case when there is no breakage in the heat generating pattern of the fixing sleeve 20 and the case when the breakage occurs in the heat generating pattern of the fixing sleeve 20 becomes large.

(Check Result)

FIG. 19 shows a waveform of a voltage applied between opposite terminals of the shunt resistor 1*d* of the current monitoring sensor 1 in this embodiment. A solid line represents the voltage waveform in the case when there is no breakage in the heat generating pattern of the fixing sleeve 20, and a broken line represents the voltage waveform in the case when the breakage occurs in the heat generating pattern of the fixing sleeve 20 in the neighborhood of the current monitoring sensor (device) 1. In the case when the breakage occurs, the current does not flow and a signal of the current monitoring sensor (device) 1 becomes small, so that a voltage value decreases by 55%.

As described above, by employing the constitution the magnetic shield surrounding the magnetic core prevents the magnetic flux to enter the magnetic core 1*a* through a place other than the openings of the current monitoring sensor (device) 1, so that detection accuracy is further improved and reliability is enhanced. In this embodiment, by using an electroconductive member as the magnetic shield, electromagnetic wave is absorbed and multiple-reflected, whereby electromagnetic energy is attenuated. Incidentally, also in the case when the magnetic field is shielded by absorbing the magnetic flux with use of ferromagnetic material, a similar effect is achieved. In that case, a material of the magnetic shield 1*g* may desirably be a soft magnetic material such as ferrite, permalloy, or silicon steel.

Fourth Embodiment

This embodiment is different in breakage discriminating means from the first to third embodiments. Other constitution of main component parts of the fixing sleeve, the thermistor and the fixing device are similar to those in the above-described embodiments.

In the following, the breakage discriminating means in this embodiment will be specifically described with reference to FIG. 20. Around a magnetic core 21, each of induced current detection coils 60*a* and 60*b* is wound one time (one turn). A winding position of the detection coil 60*b* coincide with a position of the thermistor 2 with respect to the longitudinal direction of the fixing sleeve 20. A position of the detection coil 60*a* is a symmetrical position with the position of the detection coil 60*b* with respect to a longitudinal center position of the magnetic core 21.

One terminal of the detection coil 60*b* is connected to the ground, and the other terminal is connected so as to be in series with the detection coil 60*a* (hereinafter, this coil connected in series is represented by a detection coil 60*a-b*). Further, the detection coil 60*a-b* is connected, with respect to the detection coils 60*a* and 60*b*, in series in directions in which generated voltages cancel each other. The other terminal of the detection coil 60*a* is connected to an I-V conversion circuit 45, and an output of the I-V conversion circuit 45 is inputted to the detection result comparing portion 44.

The detection result comparing portion 44 analyzes a signal which has been sent, and for example, in the case when the detection result comparing portion 44 discriminates that the sent signal is different from a voltage waveform during normal operation stored in an unshown memory, the detection result comparing portion 44 discriminates that the fixing sleeve 20 is broken. In that case, the detection result comparing portion 44 sends a breakage detection signal to the engine controller, and the engine controller stops the supply of the electric power to the fixing sleeve 20.

Part (a) of FIG. 21 shows a current waveform I1 during energization of a driving current to an exciting coil 22, an induced current waveform Ia flowing through the detection coil 60*a*, and an induced current waveform Ib flowing through the detection coil 60*b*, in the case when there is no breakage in the heat generating pattern of the fixing sleeve 20. Part (a) of FIG. 21 further shows an induced current waveform (Ia+Ib: combined (synthetic) waveform) flowing through the detection coil 60*a-b*. Part (b) of FIG. 21 shows respective current waveforms in the case when the breakage occurs in the heat generating pattern of the fixing sleeve 20 in the neighborhood of a winding position of the detection coil 60*b* which is the same position as the thermistor 2 with respect to the longitudinal direction of the fixing sleeve 20.

In part (a) of FIG. 21, when the driving current I1 flows through the exciting coil 22, the induced current Ia is generated in the detection coil 60*a*, and the induced current Ib is generated in detection coil 60*b*. The detection coil 60*b* is wound in an opposite direction to the detection coil 60*a* at a symmetrical position with the detection coil 60*a*, and the induced current Ib is the same in amplitude as the induced current Ia and is reversed in the direction. The detection coils 60*a* and 60*b* are connected in series, and therefore, the currents flowing through the detection coils 60*a* and 60*b* are canceled with each other, so that the combined current Ia+Ib becomes substantially 0.

On the other hand, in part (b) of FIG. 21, in the case when the breakage occurs in the heat generating pattern of the fixing sleeve 20 at a portion C, the induced current Ib generating in the detection coil 60*b* increases in amplitude. This is because a resistance value of the fixing sleeve 20 with respect to the circumferential direction substantially increases and therefore an amount of a circumferential current of the fixing sleeve 20 induced by the magnetic flux decreases. Correspondingly, in proportion thereto, an amount of the current induced on the detection coil 60*b* side increases. As a result, the currents flowing as the induced currents Ia and Ib cannot be canceled with each other, so that the combined current Ia+Ib flows in an amplitude amount depending on a breakage amount.

The current is converted into a voltage by the I-V conversion circuit 45, and the voltage is discriminated by the detection result comparing portion 44 whether or not the voltage is a predetermined threshold or more. As described above, in this embodiment, the breakage can be detected utilizing an increase in proportion of the current amount induced in the detection coil 60*b* side correspondingly to a decrease in circumferential current amount of the fixing sleeve 20 on the detection coil 60*b* side where the detection coil 60*b* is wound around the magnetic core 21.

In this embodiment, disposing the detection coils 60*a* and 60*b* in bilaterally symmetrical positions with respect to the longitudinal center position of the magnetic core 21 results in easy detection of an increment of the induced current Ib. Therefore, in the case when there is no breakage in the heat generating pattern of the fixing sleeve 20 in part (a) of FIG. 21, it is preferable that the current waveforms of the induced currents Ia and Ib closely resemble each other. In the case when the breakage occurs in the heat generating pattern of the fixing sleeve 20 in part (b) of FIG. 21, when the change in induced current Ib can be largely ensured, it is not necessarily required that the detection coils 60*b* and 60*a* are disposed at the bilaterally symmetrical positions.

In that case, by changing the position of the detection coil 60*a* without changing the position of the detection coil 60*b*, as in the case of a detection coil 60*c* in FIG. 22, it is also possible to employ a constitution in which the detection coil 60*c* is wound around entirety of the magnetic core 21.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

a sleeve that is rotatable while contacting a recording material on which an image is formed, said sleeve having an inside space and including a plurality of divided heat generating layers arranged along a longitudinal direction of said sleeve, each of said divided heat generating layers having a ring shape;

an exciting coil provided in the inside space of said sleeve, said exciting coil having a helix, the helix of the exciting coil being substantially parallel to the longitudinal direction of said sleeve;

a magnetic core provided inside said exciting coil;

a temperature detecting element opposing one of said divided heat generating layers; and a current monitoring sensor, wherein an induced current is generated in said divided heat generating layers by passing an alternating current through said exciting coil, and said divided heat generating layers generate heat, wherein the image on the recording material is heated by said divided heat generating layers, and wherein said current monitoring sensor is configured to monitor a current flowing through said one of said divided heat generating layers opposing said temperature detecting element.

2. The image heating apparatus according to claim 1, wherein said exciting coil provided in the inside space of said sleeve is a first exciting coil and said magnetic core is a first magnetic core, wherein said current monitoring sensor includes a second exciting coil and a second magnetic core penetrating through an inside of said second exciting coil, and wherein said current monitoring sensor monitors the current flowing through said one of said divided heat generating layers by a voltage generated in said second exciting coil by the current flowing through said one of said divided heat generating layers.

3. The image heating apparatus according to claim 2, wherein said second magnetic core has a U-shape provided with two legs, and wherein said second exciting coil and said second magnetic core are provided so that the two legs are substantially parallel to the longitudinal direction of said sleeve.

4. The image heating apparatus according to claim 3, wherein said second exciting coil and said second magnetic core are disposed inside or outside said sleeve, and wherein a third magnetic core configured to guide magnetic flux passing through said second magnetic core is provided at a position opposing said second magnetic core through said sleeve.

5. The image heating apparatus according to claim 3, wherein said second exciting coil and said second magnetic core are disposed inside said sleeve, and wherein a third magnetic core configured to guide magnetic flux passing through said second magnetic core is provided at a position opposing said second magnetic core through said sleeve.

6. The image heating apparatus according to claim 3, wherein, in the circumferential direction of said sleeve, said temperature detecting element is located at a position different from a position of current monitoring sensor, and wherein, in the direction of the helix, the temperature detecting element is located at a position corresponding to a position that is between the two legs.

7. The image heating apparatus according to claim 1, wherein said sleeve is a film.

8. The image heating apparatus according to claim 1, further comprising a controller configured to control power supplied to said exciting coil so that a temperature detected by said temperature detecting element is maintained at a target temperature.

9. The image heating apparatus according to claim 1, further comprising a controller configured to control power supplied to said exciting coil, wherein, when a temperature detected by said temperature detecting element exceeds a predetermined temperature, said controller stops the power supplied to said exciting coil.

10. The image heating apparatuf according to claim 9, wherein, when the current monitored by said current monitoring sensor exceeds a predetermined level, said controller stops the power supplied to said exciting coil.

11. The image heating apparatus according to claim 1, further comprising a magnetic shield surrounding the current monitoring sensor.

12. The image heating apparatus according to claim 1, wherein said current monitoring sensor includes a first induced current detection coil and a second induced current detection coil, wherein said first induced current detection coil and said second induced current detection coil are wound around said magnetic core and connected in series each other, wherein a winding position of said first induced current detection coil coincides with a position of said temperature detecting element with respect to the longitudinal direction of said sleeve, and wherein a position of said second induced current detection coil is in a symmetrical position with the position of said first induced current detection coil with respect to a longitudinal center position of said magnetic core.

13. The image heating apparatus according to claim 12, further comprising a controller and a comparing portion configured to compare an output through said second induced current detection coil with a predetermined voltage waveform, wherein, when said comparing portion discriminates that the output through said second induced current detection coil is different from the predetermined voltage waveform, said controller stops the power supplied to said exciting coil.

14. The image heating apparatus according to claim 1, wherein the induced current flows in a circumferential direction of said sleeve.

15. The image heating apparatus according to claim 1, wherein the plurality of divided heat generating layers are electrically insulated from each other.

* * * * *